US011786100B2

(12) United States Patent
Disch et al.

(10) Patent No.: US 11,786,100 B2
(45) Date of Patent: Oct. 17, 2023

(54) DISHWASHER, IN PARTICULAR IN THE FORM OF A COUNTER MODULE FOR A COUNTER SYSTEM

(71) Applicant: ILLINOIS TOOL WORKS INC., Glenview, IL (US)

(72) Inventors: Harald Disch, Elzach (DE); Martin Schrempp, Biberach (DE); Adrian Boldt, Offenburg (DE); Axel Beck, Offenburg (DE); Jeffrey R. Newcomer, Troy, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/238,672

(22) Filed: Apr. 23, 2021

(65) Prior Publication Data

US 2022/0338706 A1 Oct. 27, 2022

(51) Int. Cl.
*A47L 15/00* (2006.01)
*A47L 15/42* (2006.01)
(Continued)

(52) U.S. Cl.
CPC ..... *A47L 15/0065* (2013.01); *A47L 15/0021* (2013.01); *A47L 15/0089* (2013.01);
(Continued)

(58) Field of Classification Search
CPC ..... A47L 15/00–508
See application file for complete search history.

(56) References Cited

U.S. PATENT DOCUMENTS 1,502,131 A 7/1924 Vaudreuil
1,617,021 A 2/1927 Mitchell
(Continued)

FOREIGN PATENT DOCUMENTS

CN 106073683 A * 11/2016
CN 107374538 A * 11/2017
(Continued)

OTHER PUBLICATIONS

International Searching Authority, Search Report and Written Opinion issued in PCT/US2022/025465 dated Aug. 3, 2022, 13 pages.

*Primary Examiner* — Michael E Barr
*Assistant Examiner* — Omair Chaudhri
(74) *Attorney, Agent, or Firm* — THOMPSON HINE LLP

(57) ABSTRACT

A dishwasher (1) for cleaning washware items (2) in the form of drinking vessels is configured as a counter module of a counter system and includes at least one treatment zone (3) having a placement area (4) associated with the treatment zone (3) and a removal area (5) associated with the treatment zone (3), wherein the washware item (2) can be placed into the treatment zone (3) via the placement area (4) and the cleaned washware item (2) can be removed from the treatment zone (3) via the removal area (5), wherein the placement area (4) and the removal area (5) are disposed opposite one another with the interposition of the treatment zone (3). At least one bracket (15) is provided in the treatment zone (3) for in releasably securing and/or positioning the washware item (2) placed onto a placement surface (20) in the treatment zone (3).

12 Claims, 16 Drawing Sheets

Figure 1:
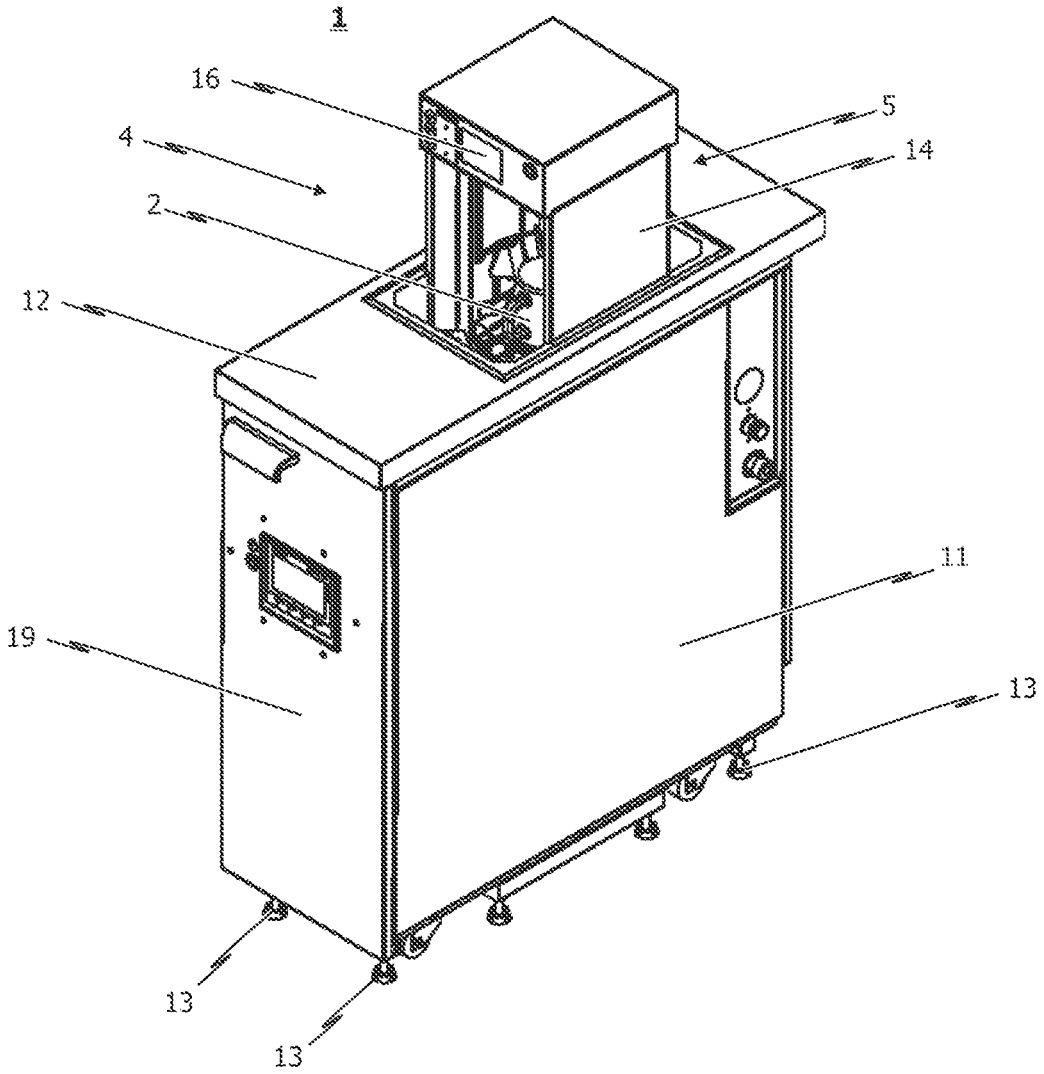

(51) Int. Cl.
*A47L 15/48* (2006.01)
*A47L 15/50* (2006.01)

(52) U.S. Cl.
CPC ..... *A47L 15/4278* (2013.01); *A47L 15/486* (2013.01); *A47L 15/50* (2013.01)

(56) References Cited

U.S. PATENT DOCUMENTS 1,693,780 A * 12/1928 Griffiths ..... A47L 15/0068 15/213
1,814,508 A * 7/1931 Griffiths ..... A47L 15/0068 15/75
3,092,120 A * 6/1963 Hilger ..... A47L 15/0086 134/55
3,460,878 A 8/1969 Peterson et al.
3,486,939 A 12/1969 Pinckard
3,886,959 A 6/1975 Stott
3,940,944 A 3/1976 Lapcyrc
3,942,545 A 3/1976 Flynn
4,825,887 A 5/1989 Nezworski
4,832,064 A 5/1989 Nezworski
5,522,410 A * 6/1996 Meilleur ..... A47L 15/0065 134/108
6,276,373 B1 * 8/2001 Gotfried ..... A47L 15/0065 134/171
6,394,285 B1 * 5/2002 Arthurs ..... A47L 15/505 211/41.9
10,945,582 B1 * 3/2021 Morman ..... G05B 19/042
2002/0020435 A1 2/2002 Varpio
2005/0072449 A1 * 4/2005 Alpert ..... A47L 15/46 134/25.1
2006/0060215 A1 * 3/2006 Lee ..... A47L 15/4244 134/172
2007/0125729 A1 * 6/2007 Krueger ..... A47G 23/0208 211/60.1
2008/0149149 A1 * 6/2008 Ryu ..... A47L 15/0065 134/201
2011/0290804 A1 * 12/2011 Kohles ..... A47L 15/503 211/41.8
2012/0111372 A1 * 5/2012 Hesterberg ..... A47L 15/0049 134/25.2
2012/0298146 A1 11/2012 Padtberg et al.
2013/0099715 A1 * 4/2013 Fuhge ..... E05F 15/79 318/484
2013/0340790 A1 * 12/2013 Lemley ..... A47L 15/502 134/1
2014/0285075 A1 * 9/2014 Lundberg ..... A47L 15/4251 312/228
2015/0107630 A1 * 4/2015 Varnals ..... A47L 15/0065 15/302
2016/0007824 A1 * 1/2016 Maier ..... A47L 15/0076 211/41.8
2016/0177493 A1 * 6/2016 Pittalis ..... G06F 3/04847 312/309
2016/0324397 A1 * 11/2016 Jung ..... A47L 15/16
2016/0338566 A1 * 11/2016 Shabtai ..... A47L 15/4234
2018/0338666 A1 * 11/2018 Seewang ..... A47L 15/4253
2019/0301073 A1 * 10/2019 Kessler ..... D06F 33/36
2021/0259509 A1 8/2021 Sperry
2021/0369076 A1 * 12/2021 McGinness ..... A47L 15/46
2022/0079413 A1 * 3/2022 Longo ..... A47L 15/16

FOREIGN PATENT DOCUMENTS

CN 109394119 A1 3/2019
CN 107233058 B * 6/2019 ..... A47L 15/0065
CN 109984703 A * 7/2019
CN 111166264 A * 5/2020 ..... A47L 15/00
CN 112190207 A * 1/2021 ..... A47L 15/0068
CN 112315397 A * 2/2021
DE 2727067 A1 1/1979
DE 4136923 A1 5/1993
DE 4241064 A1 6/1994
DE 19644438 A1 4/1998
DE 20017158 U1 12/2000
DE 20317895 U1 2/2004
DE 102013226080 A1 6/2015
DE 102018103585 A1 * 9/2018
DE 102017129799 A1 * 6/2019 ..... A47L 15/505
DE 102019119462 A1 1/2021
EP 0048519 B1 12/1984
EP 0600125 A1 6/1994
EP 0593876 B1 * 4/1997
EP 1532916 A2 5/2005
EP 2228000 B1 7/2015
EP 3015043 A1 5/2016
EP 3357398 A1 * 8/2018 ..... A47L 15/503
GB 565183 A 10/1944
JP 2002209691 A 7/2002
KR 20040087763 A 10/2004
KR 20060065289 A * 6/2006
KR 20060068402 A * 6/2006
KR 101757580 B1 * 7/2017
KR 20180068569 A * 6/2018
WO WO 2005044473 A1 5/2005
WO WO 2009011524 A1 1/2009
WO WO-2018087519 A1 * 5/2018 ..... A47L 15/0065
WO WO 2020186344 A1 9/2020
WO WO-2021011604 A1 1/2021
WO WO-2021116749 A1 * 6/2021 ..... A47L 15/0065

* cited by examiner

DISHWASHER, IN PARTICULAR IN THE FORM OF A COUNTER MODULE FOR A COUNTER SYSTEM

The present invention relates generally to a novel counter concept, which is configured to be able to prepare and sell foodstuffs in a manner that is optimal from both an economic and an ecological point of view.

More specifically, the present invention relates to a novel counter system for serving in particular at least partially unpackaged foodstuffs. Counter systems of the type considered here are counter systems for presenting, preparing, and/or selling foodstuffs, in particular at least partially unpackaged foodstuffs.

According to a further aspect, the present invention relates generally to the technical field of commercial dishwashing and in particular to dishwashers according to the preamble of independent Claim 1.

The invention accordingly relates in particular to a dishwasher for cleaning washware items in the form of drinking vessels, in particular in the form of drinking cups, mugs, glasses or bottles, wherein the dishwasher is in particular configured as a counter module of a counter system and comprises at least one and preferably exactly one treatment zone having a placement area associated with the treatment zone and a removal area associated with the treatment zone. The washware item to be cleaned can preferably manually be placed into the treatment zone via the placement area and the cleaned washware item can preferably manually be removed from the treatment zone via the removal area. In the dishwasher, it is in particular provided that the placement area and the removal area are disposed opposite one another with the interposition of the treatment zone.

The placement area of the dishwasher is in particular the soiled-side input area, which is configured such that the washware item to be cleaned in the at least one treatment zone of the dishwasher can manually be placed in there. The removal area of the dishwasher, on the other hand, is in particular the clean-side output area, which is configured to output the washware items cleaned in the at least one treatment zone of the dishwasher so that they can then be removed manually.

The dishwasher according to the invention in particular further comprises a washing and/or rinsing system having at least one washing and/or rinsing pump and having washing and/or rinsing nozzles, via which cleaning liquid, in particular washing and/or rinsing liquid, can be sprayed onto the washware item to be cleaned or the washware items to be cleaned in the at least one treatment zone of the dishwasher.

Dishwashers of the aforementioned type are already known, in particular in commercial dishwashing. Said dishwashers are in particular conveyor dishwashers, i.e. dishwashers having a conveyor apparatus for transporting the washware items to be cleaned through the at least one treatment zone of the dishwasher. Such conveyor dishwashers are commonly used in the commercial sector. Unlike domestic dishwashers, in which the washware to be cleaned remains stationary in the dishwasher during cleaning, in these conveyor dishwashers the washware is transported through different treatment zones of the machine.

Such a conveyor dishwasher is known from the document DE 19 644 438 A1, for example. Looking in the conveying direction of the washware items, the conveyor dishwasher successively comprises a preclearing zone with preclearing nozzles for removing coarse soiling on the washware, at least one wash zone with washing nozzles for spraying washing liquid onto the washware, a prerinse zone with prerinsing nozzles and a fresh water rinse zone with rinsing nozzles. The rinsing nozzles spray rinsing liquid, in particular fresh water, onto the washware. The sprayed rinsing liquid enters a prerinse tank, from which it is conveyed to the prerinsing nozzles via a pump line. The prerinsing liquid sprayed by the prerinsing nozzles flows back into the prerinse tank. A portion of the prerinsing liquid sprayed by the prerinsing nozzles is passed through a baffle or through a bypass line, for example, into the wash tank of the at least one wash zone. With the aid of a liquid cascade system, liquid can thus flow against the conveying direction of the washware from the prerinse tank into the wash tank and from there to a tank which collects the liquid sprayed by the preclearing nozzles in the preclearing zone.

In contrast to the batch processes of stationary programmed machines, such as domestic dishwashers or undercounter dishwashers, continuous operation is possible because conveyor dishwashers transport the washware through different treatment zones (in particular wash zones and rinse zones) of the machine. The disadvantage of conveyor dishwashers, however, is the relatively large space requirement in the installation room (scullery).

Nevertheless, there is an increasing need to utilize the advantages of a conveyor dishwasher in applications in which only a small installation surface is available.

Nowadays hot beverage vending machines, in particular coffee machines, of various models and sizes are almost always available for self-service in hotels, company cafeterias, public buildings, hospitals, schools and highway rest areas. These hot beverage vending machines are typically configured to fill cups with a selected hot beverage. In vending machine setups in businesses or public buildings, however, plastic cups are usually used as well.

At the same time, due to ecological considerations, the use of plastic cups is decreasing more and more in favor of reusable dishes (glasses, cups, etc.). The same effort, namely using reusable dishes in place of plastic cups, is being made at self-service coffee-shops. In these places, at least partially unpackaged foodstuffs are typically presented to the customer or potential customer in a counter system. After the customer has made a respective selection, the at least partially unpackaged foodstuffs are served to the customer in disposable dishes, in particular in disposable dishes made of plastic. In coffee shops, for example, it is common practice to serve a coffee specialty selected by the customer to the customer in a so-called coffee-to-go cup.

Given the enormous amount of plastic waste produced every day with disposable dishes, there is an effort, in self-service coffee shops as well, to reduce the amount of disposable dishes used, in particular in counter operations.

One approach to improving the ecological balance of conventional counter systems is to use disposable dishes, such as disposable coffee-to-go cups, that are recyclable. In this context, disposable dishes made of cellulose acetate or so-called oxo-biodegradable plastic, for example, are known.

The problem with such disposable dishes, however, is that the oxo-biodegradable plastic can degrade only under specific defined conditions, whereby these specific conditions generally do not exist when the disposable dishes made of oxo-biodegradable plastic is recycled. As a result, the material of the disposable dishes breaks down into microplastics and can continue to burden health and the environment.

Moreover, the production of disposable dishes made of oxo-biodegradable plastic is relatively complex and therefore likewise has a negative impact on the ecological balance.

Since the recycling probability of known reusable dishes made of so-called degradable material, such as oxo-biodegradable plastic, is very low, the ecological balance when preparing and serving in particular partially unpackaged foodstuffs can only be effectively improved if reusable dishes are used in place of disposable dishes when serving foodstuffs.

In principle, offers to (re)fill the customer-owned reusable cup with hot beverages to take out (coffee-to-go) are possible in restaurants, in the catering industry, in a cafeteria setting and in retail, provided that the respective responsible food business operator can guarantee that the relevant general hygiene requirements are fulfilled, for example the hygiene requirements defined in Art. 3 of Regulation (EC) No. 852/2004.

When (re)filling the customer-owned reusable container, such as a reusable cup, the food business operator is in particular responsible for ensuring that the reusable container can be considered to be a food contact material that is approved as safe and complies with the relevant general hygiene requirements. An example of the criteria for a food contact material approved as safe are the regulations in Art. 3 of Regulation (EC) No. 1935/2004.

When handling customer-owned cups to serve hot beverages in service or self-service, for example, the responsibility of the food business operator is limited to "solely" the perfect condition of the foodstuff up to the filling process. Since the container is the property of the customer and is filled at the explicit request of the customer, i.e. is not placed on the market by the food business operator, at least in principle, the business owner cannot be held responsible for the suitability and condition of the reusable container, for example the cup.

However, the food business operator is fully responsible for ensuring that operational processes are hygienically perfect. He is obligated to take suitable measures to ensure that the risk of contamination of the surroundings or other foodstuffs by the customer-owned cup during production, such as during the brewing and filling process for hot beverages, is controlled and minimized. This applies to both service and self-service establishments.

Due to the individual spatial situation and the different methods in the establishments, the precautions for avoiding contamination and minimizing risk when filling customer-provided containers with foodstuffs, such as when filling customer-provided cups with hot beverages, can vary. It is the responsibility of the respective business owner to gauge the hygienic risks for the respective form of delivery (service or self-service) and to carry out a corresponding risk assessment.

It should be noted here that no customer-owned containers may enter areas of businesses in which perishable food is handled openly. The handling of customer-owned containers, for example cups, by the service personnel "behind the counter" must be avoided as a matter of principle. The optimum solution is to use transfer containers or cup holders or trays for the customers' cups, so they do not leave or cross the counter/bar area and thus do not come into contact with operational equipment such as the coffee machine.

However, if customer-owned containers, for example cups for hot beverages, do not look to be sufficiently clean or seem to be unsuitable for filling, the customer has to be informed of this, even if the condition of the cup is not the responsibility of the business owner. The decision whether or not to fill at the customer's request ultimately rests with the business owner or the authorized personnel on a case-by-case basis. If the customer's reusable container is obviously soiled and poses a risk of contamination to the surroundings because filling would unavoidably involve contact with operational equipment, filling must always be refused as a precaution and out of a sense of responsibility for operational hygiene.

These food hygiene regulations when handling customer-owned containers, such as customer-owned cups for serving hot beverages in service or self-service, lead to the fact that the food business operator inherently bears a residual risk. This then again has a negative impact on the introduction of reusable dishes, in particular in food business chains such as coffee shops, because for such food business chains a risk analysis and assessment on site cannot be implemented effectively or only with great effort.

It should also be noted that local hygiene practices may vary, in particular for food business chains, in particular coffee shops, which operate worldwide.

To ensure that customer-owned containers, for example cups for hot beverages, can always comply with the food hygiene regulations, it would in principle be conceivable to provide a conventional conveyor dishwasher known in the state of the art to clean the customer-owned containers. Such a conveyor dishwasher known from the state of the art is characterized by the fact that the washware can be cleaned continuously and in the shortest possible time in a properly hygienic manner.

In practice, however, it is not possible to place a conventional conveyor dishwasher in the immediate vicinity of the counter area or in the immediate vicinity of a hot beverage vending machine, because such conveyor dishwashers require a relatively large amount of space in the installation room, which can usually not be found in the counter area of coffee shops or in the vicinity of hot beverage vending machines.

The underlying problem of the present invention is therefore that existing dishwashers or counter systems, such as those used in restaurants, in the catering industry, in a cafeteria setting and in retail, are not configured to ensure the necessary presentation, preparation and sale of foodstuffs on the one hand, while on the other hand also ensuring that in particular partially unpackaged foodstuffs can be served to the customer in an environmentally friendly manner and in compliance with the applicable hygiene requirements or hygiene regulations.

Based on this problem, the underlying object of the present invention is therefore to specify a counter system with which the existing ordering procedure, in particular in self-service coffee shops, can be ensured as before without changes or at least without significant changes, while at the same time being able to forgo disposable dishes without slowing down the work flow for taking and processing an order without additional personnel and, in particular for partially unpackaged foodstuffs, also reliably complying with the applicable hygiene requirements and/or hygiene regulations.

A further object of the present invention is to further develop a dishwasher of the abovementioned type such that it has a particularly compact structure, so that the dishwasher can also be used in applications in which conventional conveyor dishwashers cannot be used due to a lack of installation surface.

With respect to the dishwasher, the underlying object of the invention is achieved by the subject matters of the accompanying independent claims, whereby advantageous further developments of the dishwasher according to the invention are specified in the respectively dependent claims.

The invention therefore relates in particular to a dishwasher for cleaning washware items that are needed in particular in self-service coffee shops, i.e. washware items in the form of drinking vessels, in particular in the form of drinking cups, mugs, glasses or bottles.

The dishwasher is in particular configured as a counter module of a counter system and comprises at least one and preferably exactly one treatment zone having a placement area associated with the treatment zone and a removal area associated with the treatment zone. The washware item to be cleaned can preferably manually be placed into the treatment zone via the placement area and the cleaned washware item can preferably manually be removed from the treatment zone via the removal area. It is in particular provided that the placement area and the removal area are disposed opposite one another with the interposition of the treatment zone.

In the configuration of the dishwasher as a counter system, it is in particular provided that the placement area of the dishwasher is accessible from the area assigned to the customer, and in particular only from the area assigned to the customer, whereas the removal area of the dishwasher, on the other hand, is preferably accessible only from the area of the counter system assigned to the counter personnel.

A dishwasher can thus be integrated into a counter system, for example of a self-service coffee shop, whereby the placement area of the dishwasher, which in terms of commercial dishwashing corresponds to the "unclean area," is preferably accessible exclusively from the area of the counter system assigned to the customer. This ensures a reliable separation between the area "behind the counter" and the area "in front of the counter."

This measure in particular minimizes or even completely eliminates the risk of contamination by containers that are not or not properly cleaned (cups, etc.) in the area of the operational equipment necessary for filling the containers. The dishwasher also comprises a removal area, which in terms of commercial dishwashing corresponds to the "clean area." In the configuration of the dishwasher as a counter module, this "clean area" of the dishwasher is preferably accessible only from the area of the counter system assigned to the counter personnel.

This ensures in particular that no customer-owned containers, in particular cups, for example, can enter areas of businesses in which perishable food is handled openly. This in particular effectively prevents the handling of customer-owned reusable containers by the service personnel "behind the counter" without prior hygienically perfect treatment of the reusable containers.

There is also no need to provide transfer containers or cup holders or trays for the customers' cups. The solution according to the invention in particular guarantees that customer-owned containers which may not be hygienically perfect can come into contact with operational equipment, for example a coffee machine.

The dishwasher according to the invention, which is in particular embodied as a counter module, has the further advantage that the usual procedures for taking orders and preparing and serving the ordered foodstuffs do not have to be changed, or at least changed only insignificantly, despite the use of customer-owned dishes.

The offer to (re)fill customer-owned reusable containers with foodstuffs, such as customer-owned reusable cups with hot beverages to take out (coffee-to-go), can be implemented with the aid of the dishwasher according to the invention without the need for more counter personnel or the need to increase the effort required to process customer-specific and in particular customized orders.

In the dishwasher according to the invention, it is in particular provided that at least one bracket is disposed in the treatment zone of the dishwasher in order to in particular releasably secure and position the washware item that has been placed manually into the treatment zone. This ensures an especially compact structure of the dishwasher, while at the same time always achieving optimum cleaning results, because the bracket in the treatment zone automatically optimally aligns the washware item to be cleaned with respect to the washing and/or rinsing nozzles of the dishwasher.

The dishwasher is preferably configured such that the washware items (in particular drinking vessels such as cups, glasses, etc.) are placed in and also removed individually, i.e. one after the other. However, the invention is not limited to this preferred embodiment. In principle, it is also possible to load the treatment zone of the dishwasher in smaller groups.

The dishwasher according to the invention is a type of "hybrid dishwasher," in which the technology of stationary programmed machines for batch processes is combined with the technology of conveyor dishwashers configured for continuous operation, but without providing a conveyor apparatus, because, in the dishwasher according to the invention, the washware items to be cleaned are preferably placed into the bracket provided in the treatment zone and removed again manually one by one.

Since there is no need for a conveyor apparatus for transporting the washware items, it is not only possible to implement a more compact structure for the dishwasher, but also to ensure the aforementioned optimum orientation of the washware items to be cleaned by means of the bracket provided in the treatment zone. On the one hand, therefore, the dishwasher according to the invention has the advantage of stationary programmed machines designed for a batch process, while, on the other hand, the advantage of conveyor dishwashers is being utilized as well.

According to preferred implementations of the dishwasher according to the invention, the treatment zone of the dishwasher is in particular dimensioned and/or configured such that exactly one drinking vessel can be accommodated in the treatment zone. Therefore, in this preferred implementation, the dishwasher is configured such that the washware is placed in one at a time.

In this preferred configuration of the dishwasher, the bracket in the treatment zone of the dishwasher is configured to independently position and/or true the drinking vessel, in particular in the middle and preferably centrally in the treatment zone.

The bracket is preferably further configured such that a drinking vessel can be brought, preferably manually and in particular with one hand, into operative connection with the bracket via the placement area and can be removed, preferably manually and in particular with one hand, from the bracket via the removal area.

With respect to the bracket provided in the treatment zone, it is conceivable that it comprises two holding elements separated from one another via a separating gap. The two holding elements are flexible or flexibly mounted such that an inner circumference defined by the two holding elements can be adapted to different diameter objects to be accommodated by the bracket.

Alternatively or additionally, it is conceivable that the two holding elements of the bracket are mounted so as to be movable relative to one another, in particular mounted so as to be longitudinally displaceable or rotatable, namely such that an inner circumference defined by the two holding elements can be adapted to different diameter objects to be accommodated by the bracket.

According to preferred implementations, it is particularly provided that the bracket comprises a drinking vessel receptacle, in particular in the form of a depression or in the form of a groove region, for positioning and/or truing a drinking vessel accommodated by the bracket. In this context, the drinking vessel should in particular be placed in the bracket in an upside-down state.

In order for the bracket to be able to securely accommodate washware items of different diameters, the bracket should comprise at least two oppositely disposed, in particular spring-loaded holding elements, between which a holding region for the drinking vessel is formed. The holding elements of the bracket are advantageously configured such that a drinking vessel can be introduced, in particular placed via horizontal movement, manually and in particular with one hand into the holding region of the bracket via the placement area and can be removed preferably manually and in particular with one hand from the holding region of the bracket via the removal area of the dishwasher.

The bracket provided in the treatment zone is used to in particular releasably secure and/or position the washware item that has been placed on a placement surface in the treatment zone. The bracket is preferably configured to independently position and/or orient the washware item or the drinking vessel in the treatment zone with respect to a jet direction, in particular the main jet direction, of at least one washing and/or spray nozzle of the dishwasher.

To enable easy operation, the bracket should preferably be configured such that a drinking vessel can be brought, preferably manually and in particular with one hand, into operative connection with the bracket via the placement area and can be removed, preferably manually and in particular with one hand, from the bracket via the removal area.

According to implementations of the dishwasher according to the invention it is provided that the bracket comprises a drinking vessel receptacle, in particular in the form of a depression or in the form of a groove region, or the bracket is configured at least partly as a drinking vessel receptacle, in particular in the form of a depression or in the form of a groove region, to position and/or orient a drinking vessel with respect to a jet direction, in particular the main jet direction, of at least one washing and/or spray nozzle of the dishwasher. It is in particular preferably provided that the washware item be placed on the placement surface in the treatment zone in an upside-down state.

To ensure that no residual moisture or water droplets remain after the treatment of the washware item in the treatment zone, in particular on the contact surface between the washware item and the placement surface, it is provided that the placement surface is at least partly inclined relative to the horizontal, preferably by an angle of 5° to 35°, and even more preferably by an angle of 10° to 30°, and even more preferably by an angle of 22 to 28°.

To further optimize the drying result, it is preferably alternatively or additionally provided that the placement surface is in particular formed at least partly by a strut structure, in particular a lattice-like strut structure.

According to implementations of the solution according to the invention, in particular in those in which the placement surface is at least partly inclined relative to the horizontal, it is provided that the bracket comprises a support arrangement, in particular in the form of a support strut arrangement for supporting a washware item accommodated in the treatment zone and placed on the placement surface which is in particular inclined with respect to the horizontal.

According to configurations of the dishwasher, to optimize the drying result, it is provided that the dishwasher comprises an air-blowing system having at least one air-blowing nozzle. The at least one air-blowing nozzle is configured and oriented with respect to the placement surface such that water droplets can be blown off the washware item with the air-blowing nozzle.

The air-blowing system is in particular configured to preferably automatically blow compressed air in the direction of the washware item via the air-blowing nozzle after completion of a rinsing phase, or to preferably automatically blow compressed air in the direction of the washware item via the air-blowing nozzle as the washware item is removed from the treatment zone.

According to a further aspect of the present invention, said invention relates to a dishwasher of the aforementioned type or according to the preamble of independent Claim 1, wherein, according to this aspect, it is in particular provided according to the invention that the dishwasher comprises a cleaning system having at least one cleaning nozzle, which is configured to preferably automatically clean the placement area of the dishwasher, for example after loading the treatment zone with a washware item.

This aspect is advantageous in particular when the treatment zone of the dishwasher is configured to accommodate and clean the washware item to be cleaned, i.e. the drinking vessel to be cleaned, in an upside-down state.

In particular when placing in the customer-owned reusable cup to be cleaned, it is often impossible to avoid contaminating the placement area, in particular, for example, if there is still residual liquid in the container. The placement area is automatically cleaned by the preferably automatic, and even more preferably optionally automatic, activation of the cleaning system.

According to a further aspect of the invention, a dishwasher of the aforementioned type according to the invention or a dishwasher according to the preamble of Claim 1 is provided, wherein, according to the invention, the treatment zone is in particular associated with at least one door, in particular in the form of a Tambour door, via which a placement opening and/or removal opening at the placement area or the removal area can be closed as needed and in particular automatically after the placement of a drinking vessel into the treatment zone.

This can effectively prevent clouds of steam and/or water spray from escaping the treatment zone during operation of the dishwasher.

As an alternative to a door, it is also conceivable to provide a corresponding splash guard, for example in the form of a splash curtain, in the placement opening and/or the removal opening.

To further prevent the escape of steam from the treatment zone, it is conceivable that the treatment zone is associated with an exhaust system, which is preferably activated or can be activated automatically and in particular as needed, to suction off clouds of steam and thus prevent said steam from entering the counter area.

The at least one door, via which the placement opening and/or the removal opening of the dishwasher can preferably be closed as needed and in particular automatically, should be transferable in a horizontal plane relative to the treatment zone between an open position, in which the placement opening and the removal opening are open, and a closed position, in which the placement opening and the removal opening are closed.

Alternatively, it can also be useful for the at least one door to be reversibly transferable in a vertical plane relative to the treatment zone between the open position and the removal opening, whereby, however, in the open position of the door, the door is not above the treatment zone but is moved downward relative to the treatment zone into a body of the dishwasher. This effectively prevents the at least one door from moving into the field of view of the customer or counter personnel in the open position of the treatment zone, as would be the case with conventional hood-type dishwashers, for example.

According to a further aspect, the present invention relates to a dishwasher of the aforementioned type or a dishwasher according to the preamble of Claim 1, wherein the dishwasher further comprises a washing and/or rinsing system having washing and/or rinsing nozzles, via which cleaning liquid, in particular washing and/or rinsing liquid, can be sprayed onto the drinking vessel to be cleaned in the treatment zone.

In this concept, it is in particular provided according to the invention that the dishwasher is spatially partitioned into an over table area, which, when the dishwasher is used as intended, is positioned above a counter level, and an under table area, which, when the dishwasher is used as intended, is positioned below the counter level. The placement area, the removal area and at least partly the at least one treatment zone are respectively part of the over table area, whereby at least one washing and/or rinsing pump of the washing and/or rinsing system is part of the under table area.

Such a configuration of the dishwasher is in particular suitable for coffee shops in which customers bring their own cup, but said cup has to be cleaned on site before being filled with a hot beverage, for example. The cup to be cleaned can then manually be placed individually into the treatment zone via the placement area and manually removed via the removal area after suitable cleaning.

By partitioning the dishwasher into an under table area, in which substantially all of the technology needed to operate the dishwasher is housed, and an over table area which comprises the placement and removal area and at least partly the area of the treatment zone, the dishwasher according to the invention can ideally be integrated into a counter system, in particular that of a coffee shop.

All of the components associated with the technology of the dishwasher are preferably integrated into the under table area of the dishwasher in order to keep the area above the counter as free as possible, which is a basic requirement for the integration of the dishwasher into a counter system.

According to implementations of the dishwasher according to the invention, at least one of the following components is at least partly and preferably fully integrated into the under table area of the dishwasher:

- a rinse aid dosing system for in particular selective and/or as needed dosing of rinse aid to the cleaning liquid to be sprayed in the at least one treatment zone;
- a cleaner dosing system for in particular selective and/or as needed dosing a cleaner chemical to the cleaning liquid to be sprayed in the at least one treatment zone;
- a wash tank for at least temporarily storing the cleaning liquid to be sprayed in the at least one treatment zone and/or for temporarily storing the cleaning liquid sprayed in the at least one treatment zone;
- a rinsing liquid tank for providing rinsing liquid to be sprayed in the at least one treatment zone, to which rinse aid is added as necessary;
- a wastewater tank for at least temporarily storing wastewater produced during the cleaning of the washware items;
- a water heater for in particular selective and/or as needed heating of the cleaning liquid to be sprayed in the at least one treatment zone; and/or
- a disinfectant dosing system for as needed dosing of a disinfectant to the cleaning liquid to be sprayed in the at least one treatment zone.

The aforementioned components are part of the washing and/or rinsing system of the dishwasher and are integrated into the under table area of the dishwasher.

Of course, the above list is not to be considered to be exhaustive. There is also no need to further mention that not all of the abovementioned components associated with the "technology" of the dishwasher have to be integrated in the under table area of the dishwasher, in particular fully integrated.

In a preferred implementation of the dishwasher, the dishwasher comprises a body having an upper horizontal plane, which is positioned below the counter level or which defines the counter level, whereby the under table area of the dishwasher is formed by the body.

The term "body" used here refers in particular to the supporting part of the dishwasher (support frame). The body can comprise side portions, an upper and lower floor, and a rear wall, although this is not absolutely necessary. Fixed middle sides, fixed intermediate floors and front portions can be part of the body as well.

The body preferably comprises at least one door, through which access to the components accommodated in the body and in particular associated with the "technology" of the dishwasher is possible.

The body of the dishwasher is preferably supported by height-adjustable feet or by castors or by an in particular height-adjustable substructure, base, frame or the like.

With this measure, the counter height, i.e. the counter level of the dishwasher, can be adjusted in vertical direction, and in particular adapted to counter concepts or counter systems, in particular already existing counter systems.

In this context, it is in particular conceivable that the upper horizontal plane of the body is configured at least partially as an upper floor. This allows the dishwasher to be integrated directly into an existing counter system without interrupting the counter level.

In the region of the at least one treatment zone, the upper floor of the body should preferably comprise at least one passage or opening, through which at least cleaning liquid can be transferred from the under table area, i.e. from the technology accommodated in the under table area, to the over table area, and in particular to the at least one treatment zone of the dishwasher, and vice versa.

In the area of the treatment zone, there is preferably a depression in the upper floor of the body. This makes it possible to implement a horizontal bearing surface and in particular a drinking vessel receptacle of the bracket which is disposed below the counter level. This particularly effectively prevents water spray from escaping the area of the treatment zone during operation of the dishwasher. Contamination of the door, which is preferably closed during operation of the dishwasher, by water spray is also at least reduced.

For larger coffee shops in particular, it is advantageous if two drinking vessels can be placed into the treatment zone at the same time.

The dishwasher according to the invention should advantageously be associated with a control device, which can likewise be integrated into the under table area or in the body of the dishwasher, for example. In particular the treatment parameters necessary and/or desired for cleaning the washware items (temperature of the cleaning liquid, nozzle pressure, etc.) can be selected and/or set via the control device.

According to preferred implementations of the dishwasher according to the invention, the control device is in particular configured to control the washing and/or rinsing system of the dishwasher or the technology associated with the washing and/or rinsing system of the dishwasher for the purpose of treating the washware items in the at least one treatment zone such that first at least one washing phase and then at least one rinsing phase, in particular a fresh water rinsing phase, and optionally a disinfecting phase is carried out in chronological succession.

Field tests have shown that sufficient cleaning of the washware items can already be achieved if the at least one washing phase lasts between 5 to 30 seconds and preferably between 5 to 20 seconds and even more preferably about 15 seconds.

A disinfecting phase should last between 1 to 10 seconds and preferably about 7 seconds, while the rinsing phase lasts between 1 to 10 seconds, preferably between 2 to 8 seconds and even more preferably between 3 to 5 seconds.

The rinsing phase can include an (additional) cold water postrinse after the actual NSF cleaning process in order to condense steam and thus minimize the escape of steam when opening the at least one door, and also to reduce the cup temperature to no more than 50° C.

Of course, significantly longer times for the washing phase, disinfecting phase and/or rinsing phase are also conceivable, but longer time periods would be disadvantageous when using the dishwasher in the counter area of a coffee shop in particular.

This aspect is based on the consideration that the dishwasher should advantageously be designed such that complete cleaning of a washware item can be carried out within about 30 to 60 seconds, i.e. within the typical time period in which an order can be taken and settled by the counter personnel.

Accordingly, in particular also because the placement area of the dishwasher is accessible from the area of the counter system assigned to the customer, when ordering from the counter personnel, the customer can place his own reusable container into the dishwasher via the placement area. After the ordering and billing procedure, which typically takes between about 30 to 60 seconds, the cleaned, customer-owned reusable container is then ready at the removal area of the dishwasher, preferably in the immediate working area of the counter personnel. There are therefore no additional steps to be taken by the counter personnel if a customer's own reusable container is to be (re)filled.

It is generally advantageous for the control device of the dishwasher to be configured to automatically and preferably optionally automatically detect that a washware item has been placed into the treatment zone of the dishwasher via the placement area, in order to then, preferably after an appropriate authorization from the counter personnel, activate the technology associated with the washing and/or rinsing system of the dishwasher.

Prior to the washing and rinsing process, after a corresponding clearance by the counter personnel, the placement and removal opening of the treatment zone should be closed automatically by at least one door, whereby, however, a safeguard in the form of a pinch protection device is preferably provided here to prevent potential injuries and/or damage. As soon as the washware items are clean, the control device should automatically deactivate the technology associated with the washing and/or rinsing system of the dishwasher and open the at least one door at least in the removal area.

The optionally provided cleaning nozzle in the loading area should likewise preferably be started automatically and in a controlled manner to in particular remove contaminants, such as beverage residues that drip from the cup onto the loading area, in particular during loading. The activation of this cleaning system can be directly coordinated with the actual cleaning process.

The dishwasher according to the invention in particular significantly reduces resources (water, energy and chemicals), in particular when handling customer-owned reusable dishes in a counter system. Existing counter systems are not designed to make customer-owned, reusable containers available to the service personnel "behind-the-counter" in a hygienic manner. Rather, it is currently common practice for customer-owned reusable containers to be cleaned outside the counter area in a dishwasher. However, such (generally known) dishwashers are typically designed to clean a large number of washware items at the same time.

In practice, this means that the offer to (re)fill customer-owned reusable containers involves the reusable containers being cleaned individually in the dishwasher that is not part of the counter system, which inevitably leads to increased water, energy and chemical consumption.

In this context, it should be noted that, per reusable cup, the dishwasher according to the invention has a fresh water consumption of about 0.2 l to 0.3 l at an energy consumption of about 200 W/h, for example. It is thus possible to achieve water savings of between 50% to 70% and energy savings of the same magnitude.

Since the dishwasher according to the invention is in particular configured to clean individual washware items in batches, a particularly compact design of the dishwasher can be implemented.

According to a further development of the dishwasher according to the invention, it is in particular provided that a fresh water tank, which can preferably be fluidically connected, in particular as needed, to the fresh water mains, is integrated into the under table area of the dishwasher to supply the dishwasher with fresh water.

Alternatively or additionally, it is conceivable that a wastewater tank, which can preferably be fluidically connected, in particular as needed, to the wastewater system, is integrated into the under table area of the dishwasher to temporarily store wastewater produced during operation of the dishwasher.

With this further development, an integration of a dishwasher into the counter system can also be implemented if the counter system itself is not connected or connectable to the fresh water mains and/or the wastewater system.

In this context, it can preferably be provided that a heat exchange system is associated with the wastewater tank in order to recover at least part of the thermal energy of the wastewater produced during operation of the dishwasher as needed, and use it, for example, to heat the fresh water required during operation of the dishwasher.

The dishwasher according to the invention is in particular a type of "hybrid dishwasher," in which the technology of stationary programmed machines for batch processes is combined with the technology of conveyor dishwashers configured for continuous operation, whereby, in order to achieve a particularly compact design, a conveyor apparatus is omitted. On the one hand, the dishwasher has the advantage of stationary programmed machines designed for a batch process, while, on the other hand, the advantage of conveyor dishwashers is being utilized as well. The space required to set up the dishwasher is no more than the space required for a dishwasher configured as a stationary programmed machine.

It is particularly preferably provided that the treatment zone of the dishwasher according to the invention is delimited at least partly by at least one wall region provided above the counter area and an upper roof region. A first display arrangement associated with the placement area and preferably disposed at the upper roof region is provided to display customer-specific information.

The customer specific information is in particular instructions for the customer on how to place his drinking vessel into the bracket of the treatment zone. However, other information, such as current offers or in particular the dishwasher's energy and water consumption or information relating to the savings in resources that can be achieved with the dishwasher, can be displayed as well.

The dishwasher preferably comprises a further (second) display arrangement, which is likewise preferably disposed at the upper roof region of the treatment zone and is associated with the removal area to display information relevant to the counter personnel, such as information about whether the dishwasher is ready for a washing or cleaning cycle, information about the progress of the washing or cleaning cycle, error messages, etc.

A switching means, for example in the form of a touchscreen or in the form of a switch, via which the counter personnel can enable the operation of the dishwasher, is preferably associated with the removal area as well.

Partitioning the dishwasher according to the invention into an under table area and an upper table area in particular makes it possible to optimally utilize the area on the counter surface available to the counter personnel as a work surface, since the counter area actually "needed" by the dishwasher is only the counter area that corresponds to the placement area, the treatment zone and the removal area.

As already stated, according to further developments of the dishwasher according to the invention, the dishwasher comprises a control device to control the conveyor apparatus and the controllable components (pumps, valves, heating device, etc.) associated with the washing and/or rinsing system. The control device is preferably configured to appropriately conceptualize the transport of the washware items through the at least one treatment zone as a function of the presence or absence of washware items in the input area and/or the output area.

The dishwasher according to the invention is, as already stated, designed in particular for coffee shops. Due to its compact design, the dishwasher can be integrated into the counter concept of a coffee shop, for example.

The over table area of the dishwasher preferably has a footprint having a dimension of no more than 500 mm×500 mm and preferably no more than 400 mm×400 mm and even more preferably no more than 250 mm×600 mm and even more preferably no more than 330 mm×330 mm or no more than 229 mm×379 mm.

An overall height of no more than 500 mm for the over table area is preferred. The under table area of the dishwasher preferably has a footprint having a dimension of no more than 400 mm×600 mm and preferably no more than 300 mm×600 mm.

According to implementations of the dishwasher, the dishwasher comprises a door, for example a revolving door or a Tambour door, for closing an access opening leading to the placement area of the dishwasher as needed. It is also possible to provide a splash curtain (splash cloth) at the access opening instead of a door.

According to preferred implementations, the at least one door comprises an element which surrounds the treatment zone and comprises a first and a second through-opening and is movable relative to the placement opening and the removal opening of the treatment zone such that at least a first state, in which the first through-opening is at least substantially aligned with the placement opening of the treatment zone and the second through-opening is at least substantially aligned with the removal opening of the treatment zone, and a second state, in which the surrounding element at least substantially completely covers both the placement opening and the removal opening of the treatment zone, can selectively be implemented.

In this context, it is for example conceivable that the surrounding element is in particular a surrounding revolving door which is disposed inside the treatment zone and is mounted such that it is displaceable or rotatable relative to the placement opening and the removal opening of the treatment zone, preferably about a horizontal or vertical central axis of the treatment zone.

According to implementations of the dishwasher according to the invention, it is provided that at least one window region is configured in the surrounding element such that, in the second state of the door, the treatment zone can be visually inspected through the placement area and/or the removal area.

It is in particular advantageous that the at least one treatment zone is associated with an exhaust device for suctioning off steam, which is likewise integrated into the under table area of the dishwasher, for example. Alternatively or additionally, it is advantageous to provide a corresponding splash guard to prevent steam and/or liquid from escaping the at least one treatment zone.

The access opening of the dishwasher preferably has a height of no more than 330 mm and preferably no more than 280 mm and a width of no more than 350 mm and preferably about 178 mm. This allows drinking vessels to be placed into the placement area individually or side by side.

The over table area of the dishwasher, and in particular the controllable components of the over table area, are preferably releasably connected to the under table area or the components of the under table area, in particular via at least one quick-release coupling or plug connection.

The invention further relates to a counter module for a counter system, wherein the counter system comprises a counter area having a horizontal counter surface, and wherein the counter module comprises a dishwasher of the aforementioned type according to the invention, wherein the over table area of the dishwasher is disposed above the counter surface of the counter area and the under table area of the dishwasher is disposed below the counter surface of the counter area.

Example embodiments of the dishwasher according to the invention are described in more detail in the following with reference to the accompanying drawings.

Figure 2:
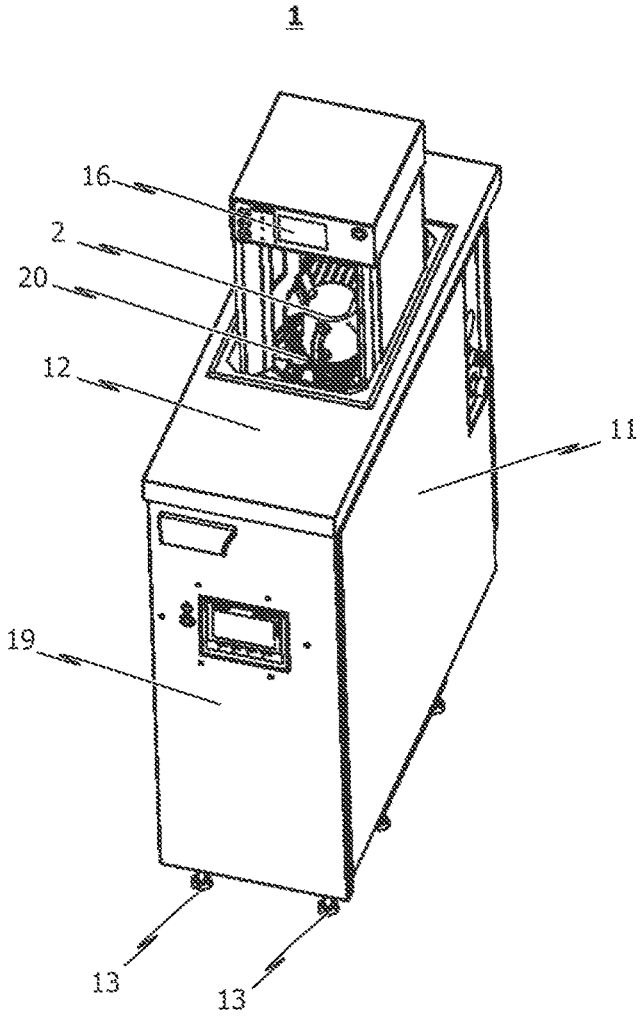
Figure 3:
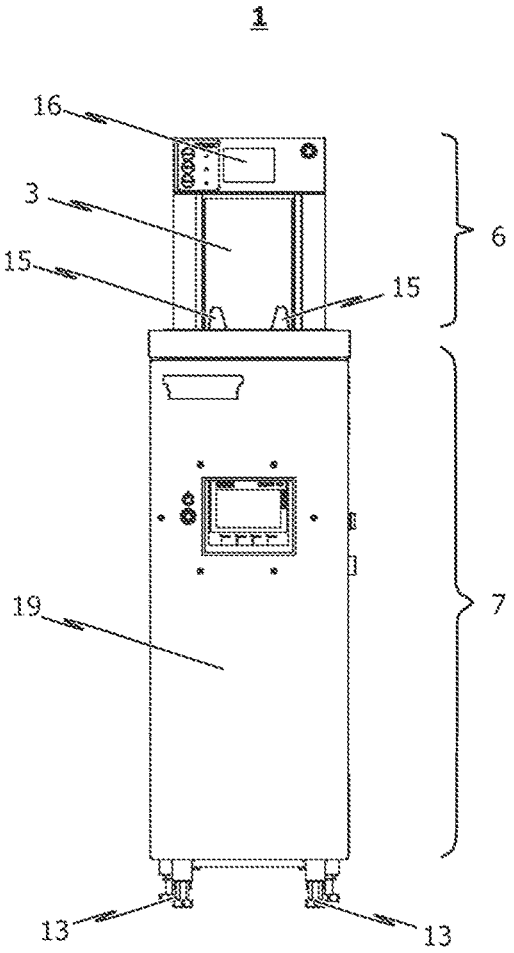
Figure 4:
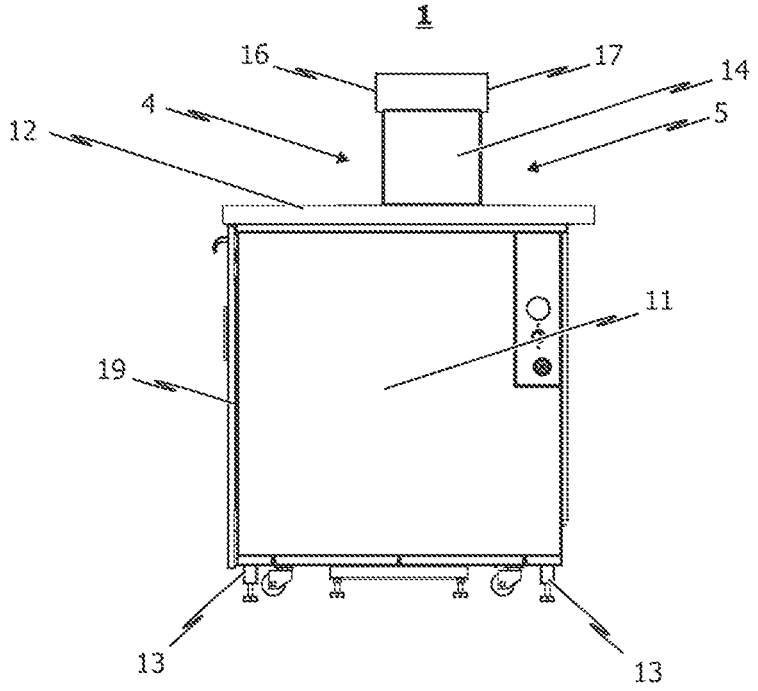
Figure 5:
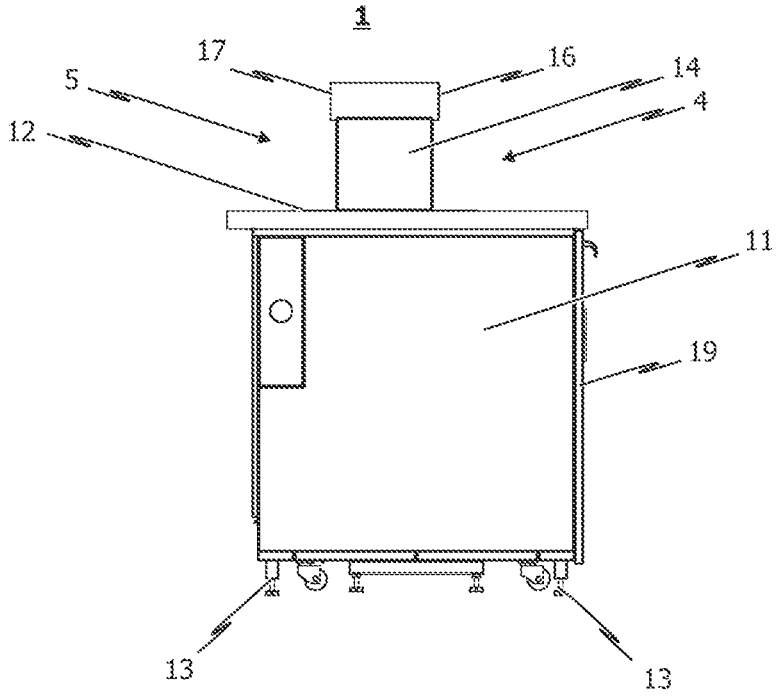
Figure 6:
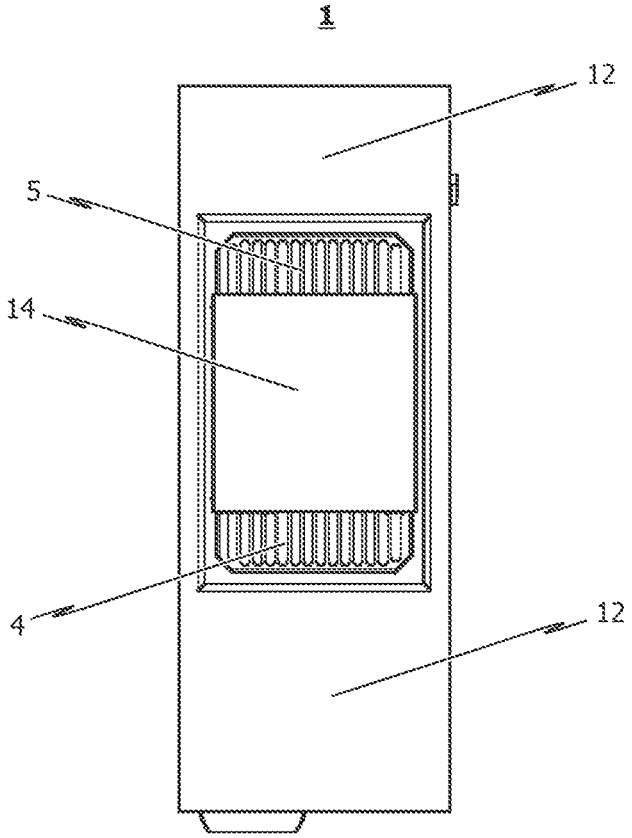
Figure 7:
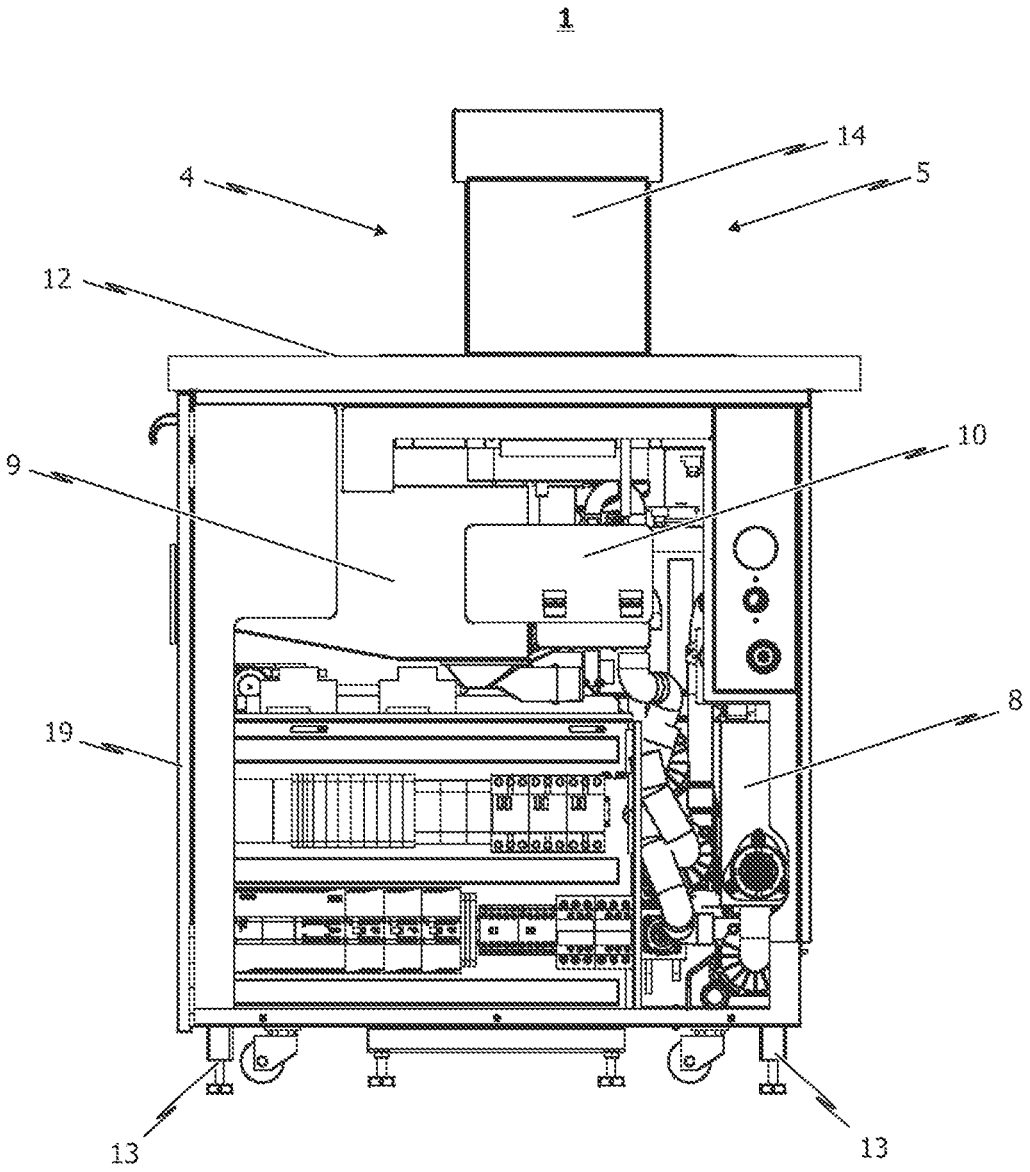
Figure 8:
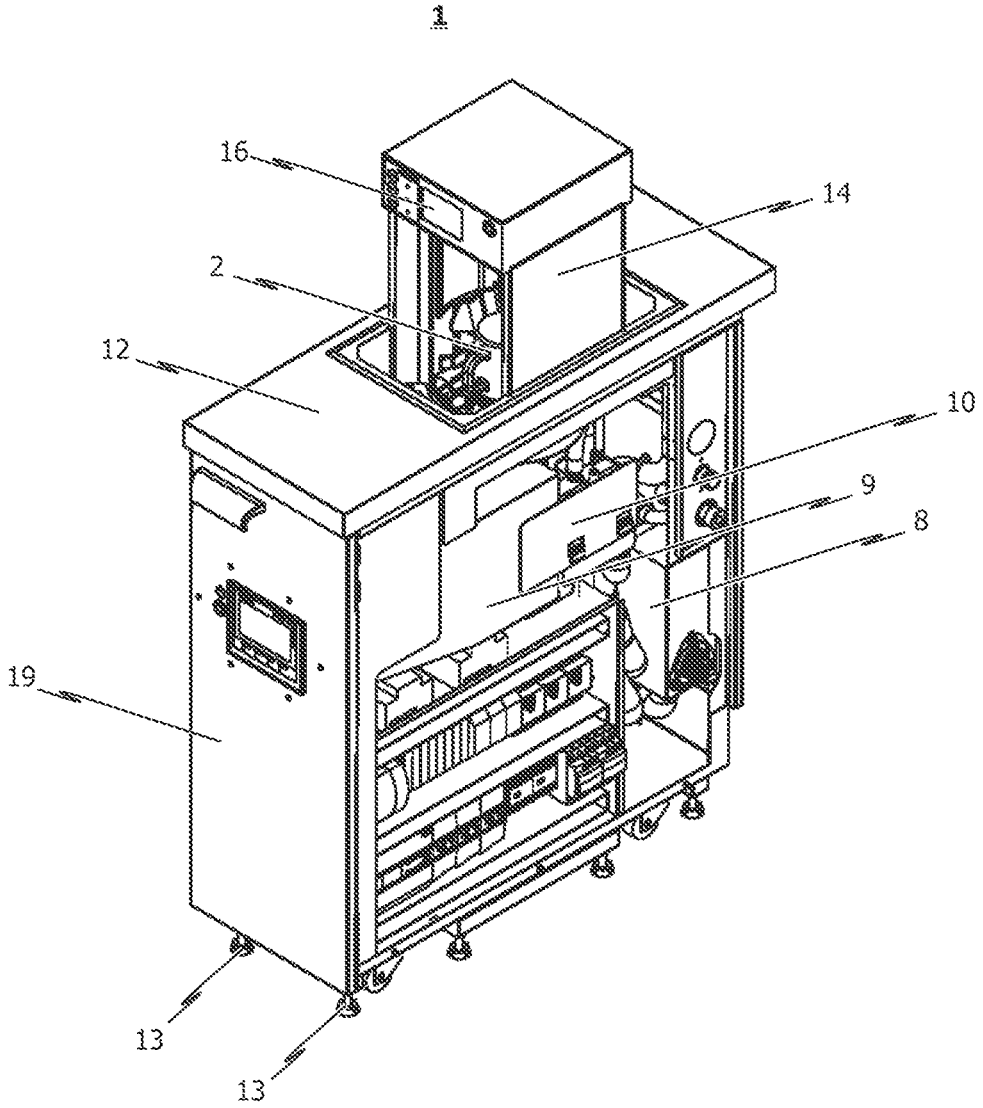
Figure 9:
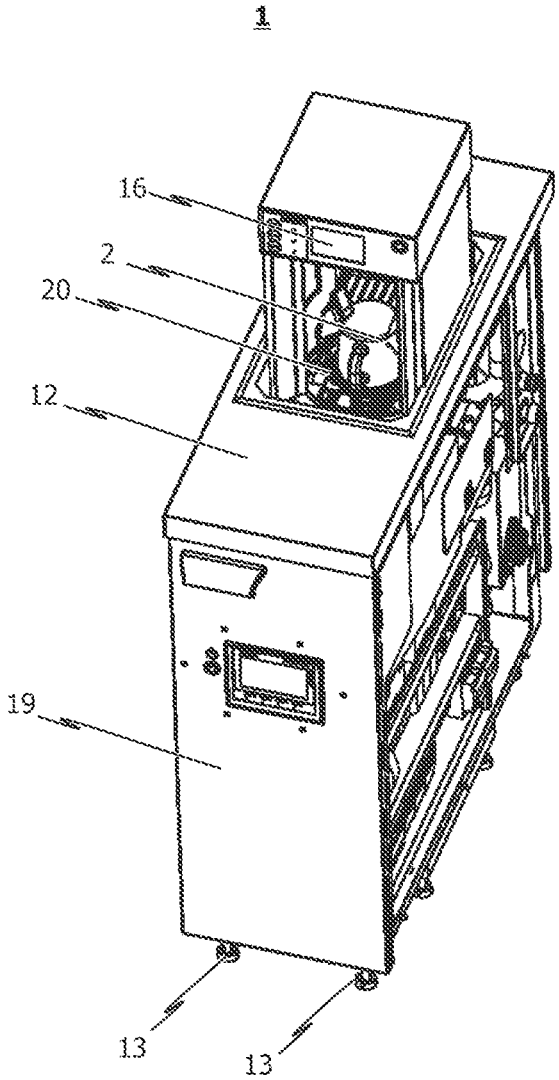
Figure 10:
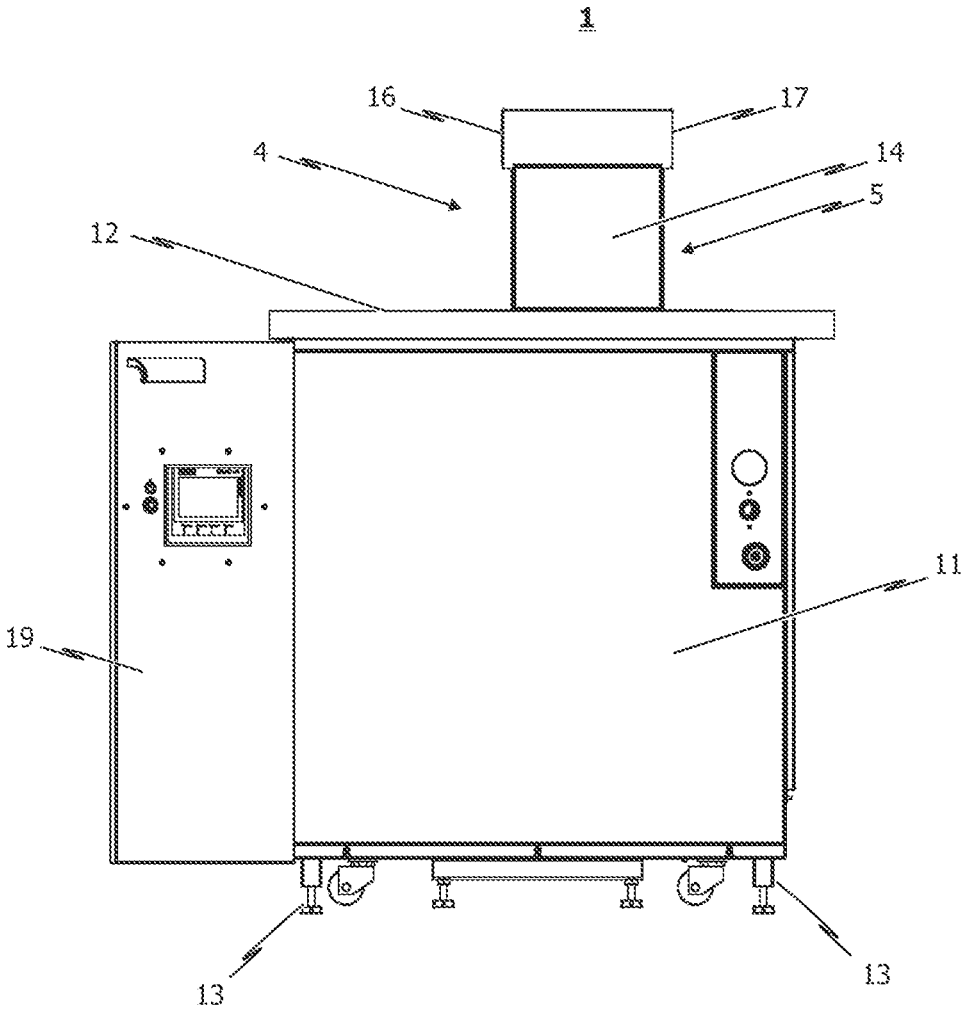
Figure 11:
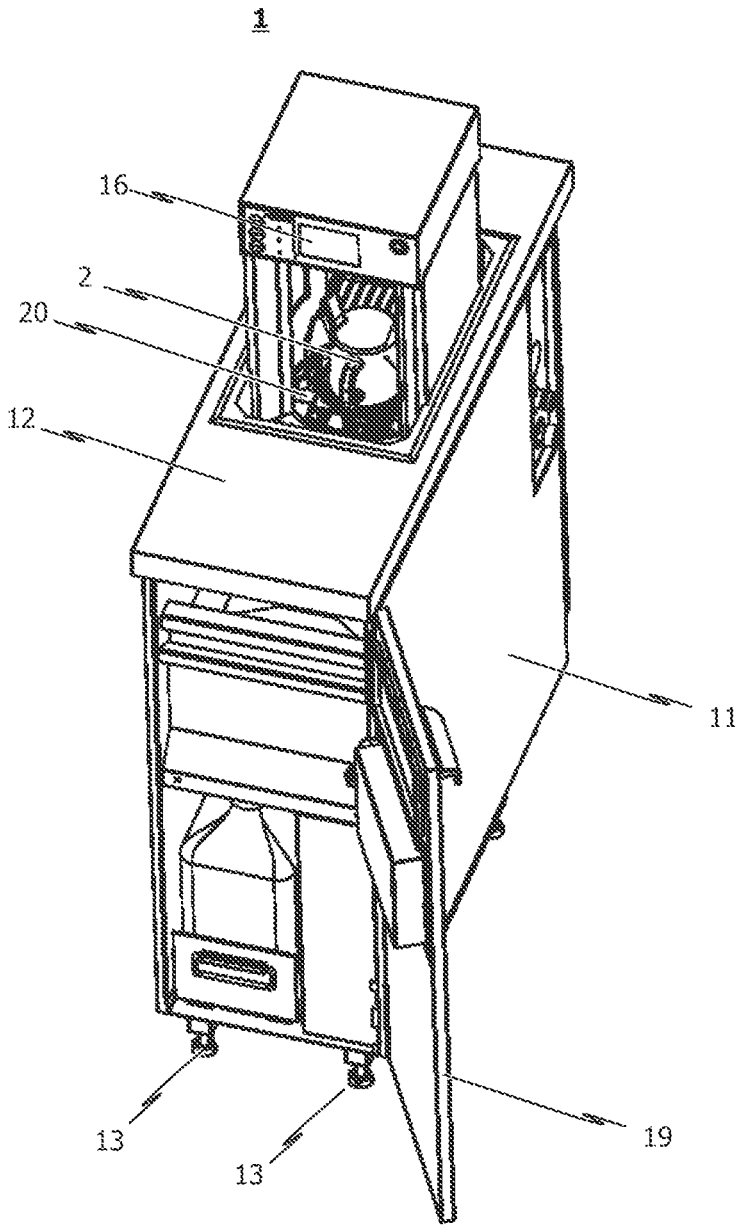
Figure 12:
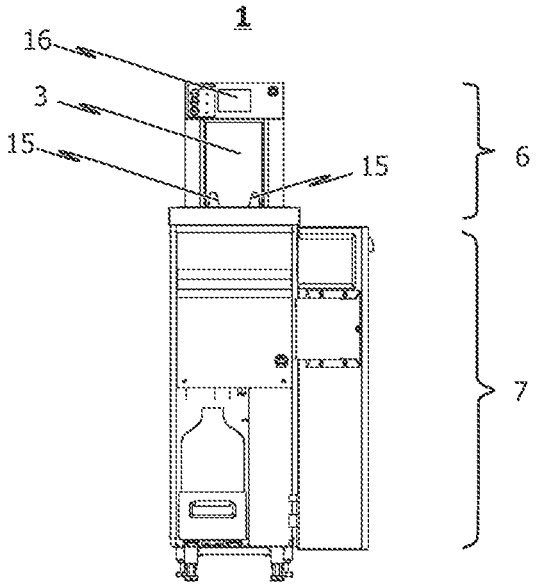
Figure 13:
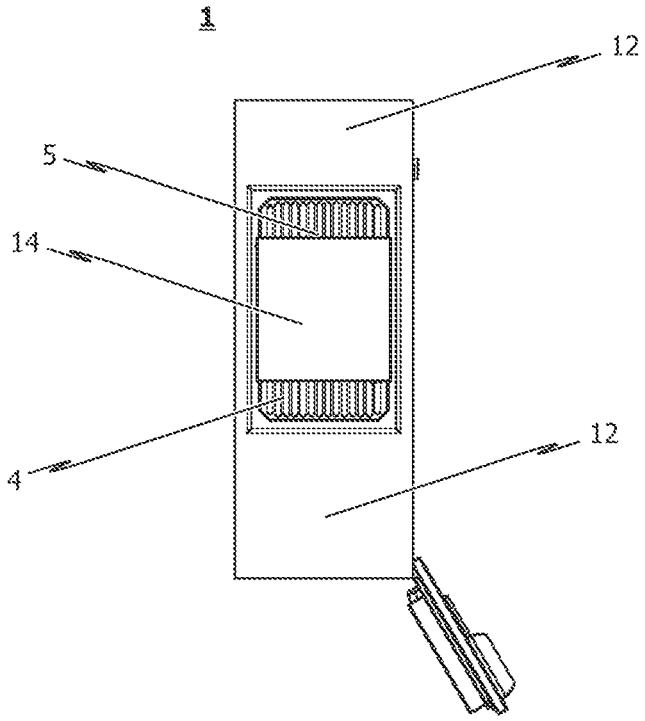
Figure 14A:
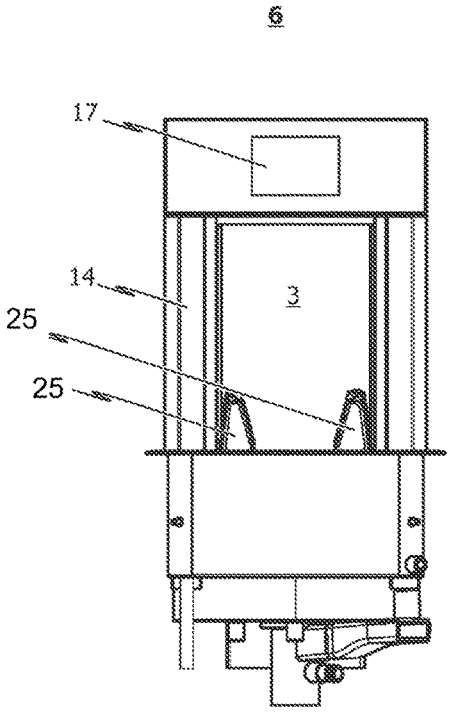
Figure 15A:
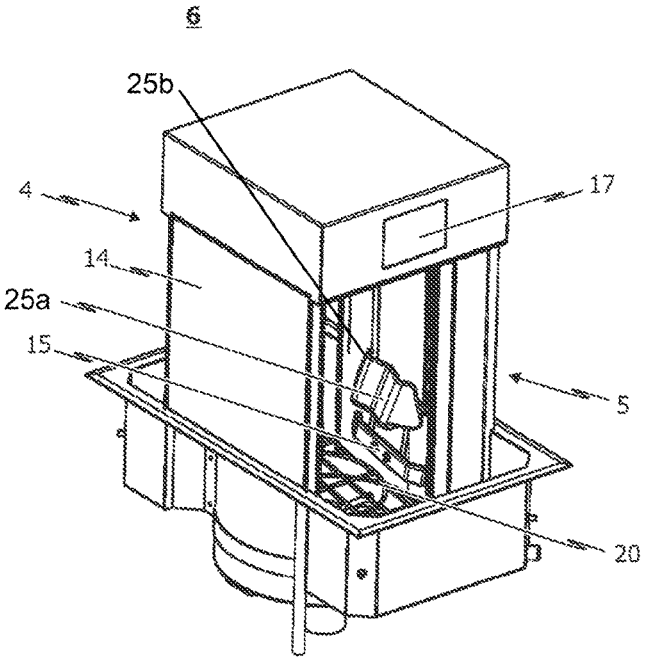
Figure 14B:
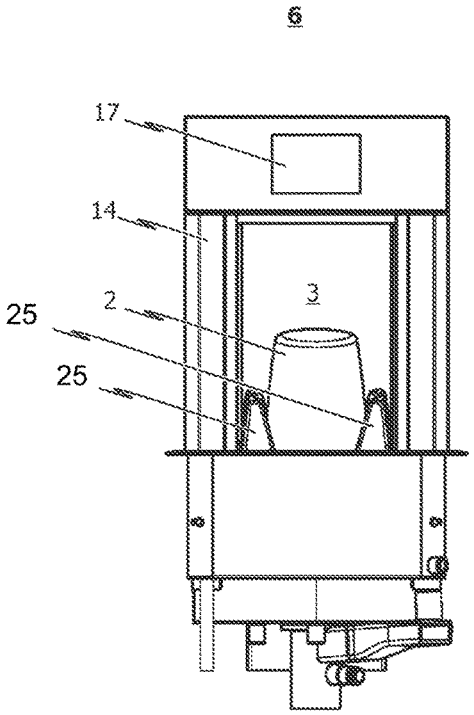

The figures show:

FIG. 1 schematically and in an isometric view, an example embodiment of the dishwasher according to the invention in which the placement opening at the placement area of the treatment zone is open;

FIG. 2 schematically, a further isometric view of the dishwasher according to FIG. 1;

FIG. 3 schematically, a view onto the placement area of the dishwasher according to the invention according to FIG. 1;

FIG. 4 schematically, a first side view of the dishwasher according to FIG. 1, FIG. 5 schematically, a second side view of the dishwasher according to the invention according to FIG. 1;

FIG. 6 schematically, a plan view onto the dishwasher according to the invention according to FIG. 1;

FIG. 7 schematically, a side view of the dishwasher according to the invention according to FIG. 1, but without the side wall region of the body of the dishwasher;

FIG. 8 schematically and in an isometric view, the example embodiment of the dishwasher according to the invention according to FIG. 7;

FIG. 9 schematically and in a further isometric view, the example embodiment of the dishwasher according to the invention according to FIG. 7;

FIG. 10 schematically and in a side view, the example embodiment of the dishwasher according to the invention according to FIG. 1, with the door of the body of the dishwasher open;

FIG. 11 schematically and in an isometric view, the example embodiment of the dishwasher according to the invention according to FIG. 10;

FIG. 12 schematically, a plan view onto the placement area of the example embodiment of the dishwasher according to the invention according to FIG. 10;

FIG. 13 schematically and in a plan view, the example embodiment of the dishwasher according to the invention according to FIG. 10;

FIG. 14*a* schematically and in an isometric view, the over table area of a further example embodiment of the dishwasher according to the invention without a washware item accommodated in the treatment zone;

FIG. 14*b* schematically and in an isometric view, the over table area according to FIG. 14*a*, with only one washware item in the form of a drinking cup accommodated in the treatment zone;

FIG. 15*a* schematically and in a view from the removal area onto the over table area according to FIG. 14*a;*

Figure 15B:
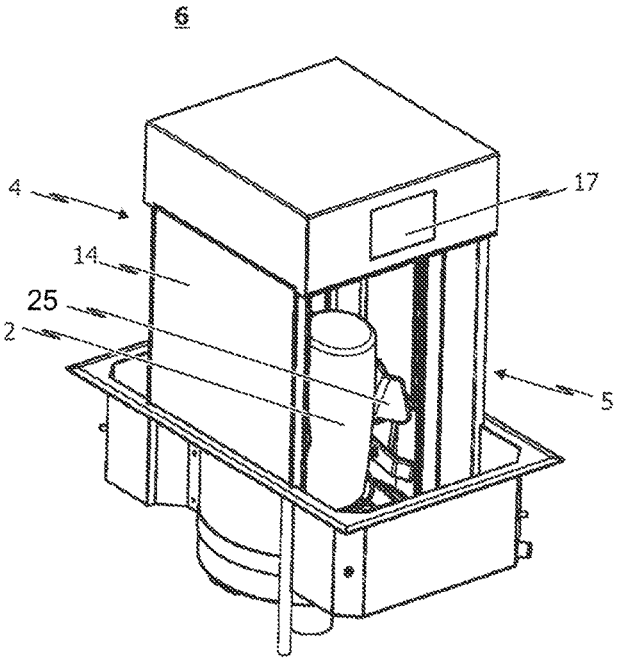

FIG. 15*b* schematically and in a view from the removal area, the over table area according to FIG. 14*b;*

Figure 16A:
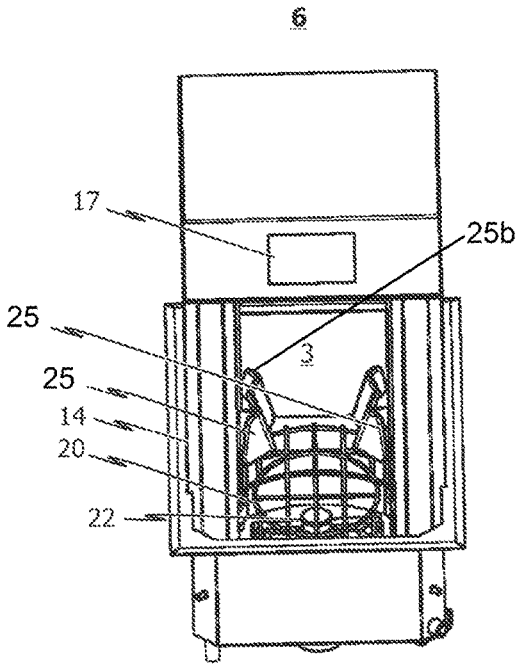

FIG. 16*a* schematically and in an isometric view from above at an angle onto the removal area of the over table area according to FIG. 14*a;*

Figure 16B:
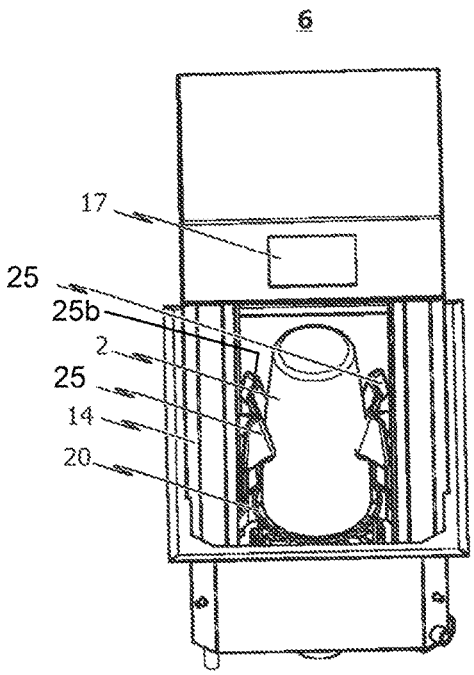

FIG. 16*b* schematically and in an isometric view from above at an angle onto the removal area of the over table area according to FIG. 14*b;*

Figure 17A:
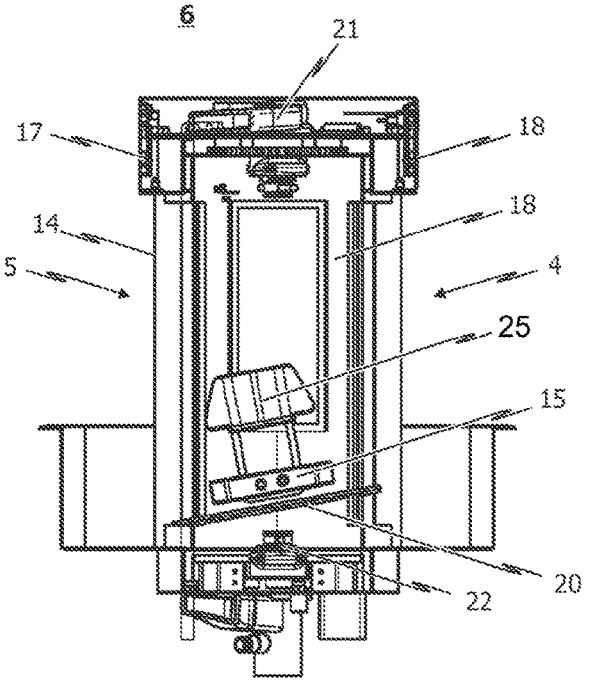

FIG. 17*a* schematically and in a longitudinal sectional view, the over table area according to FIG. 14*a;*

Figure 17B:
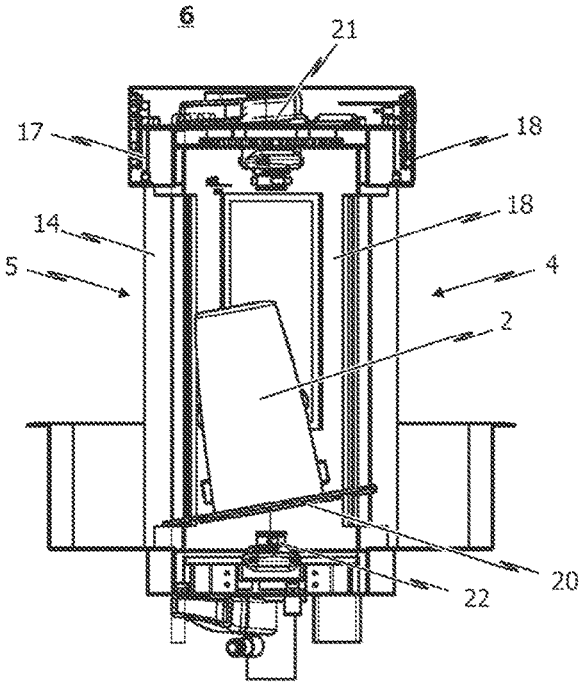

FIG. 17*b* schematically and in a longitudinal sectional view, the over table area according to FIG. 14*b;*

Figure 18A:
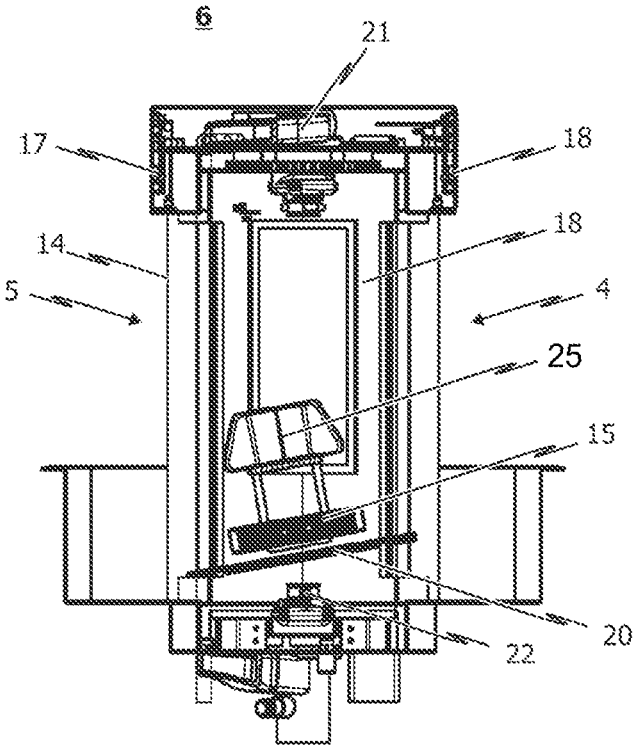
Figure 18B:
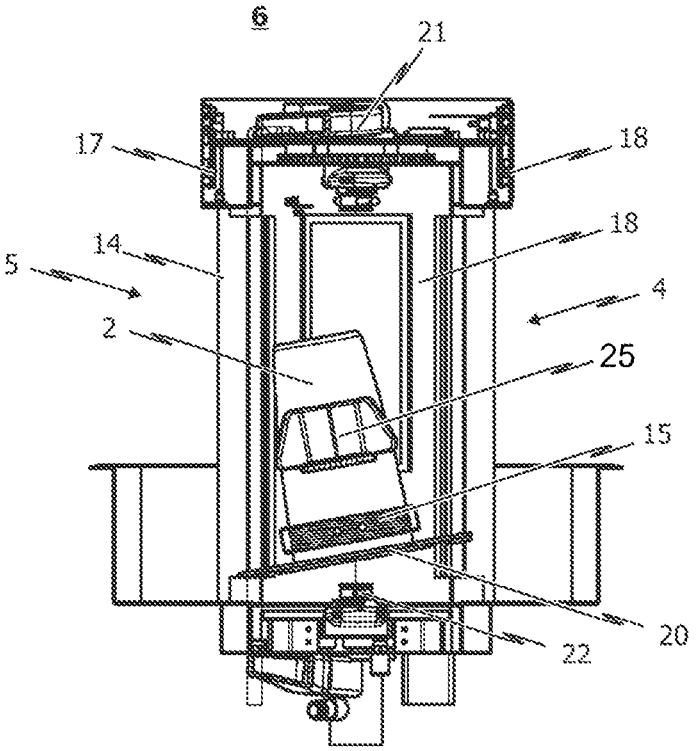

FIG. 18*a* schematically and in a central longitudinal sectional view, the over table area according to FIG. 14*a*; and FIG. 18*b* schematically and in a central longitudinal sectional view, the over table area according to FIG. 14*b*.

A first example embodiment of the dishwasher 1 according to the invention is described in the following with reference to FIG. 1 to FIG. 13 of the accompanying drawings. The dishwasher 1 is in particular configured as a counter module of a counter system and is in particular suitable for cleaning washware items 2 in the form of drinking vessels, in particular in the form of drinking cups, mugs, glasses or bottles.

For cleaning the washware items, the dishwasher 1 comprises a treatment zone 3 (here: only one) having a placement area 4 and a removal area 5. The dishwasher 1 or the treatment zone 3 is configured to treat (clean) washware items 2 individually and in batches.

The dishwasher 1 comprises a housing 14, in which the treatment zone 3 is accommodated. A first display arrangement 16, which is oriented in the direction of the placement area 4 of the dishwasher 1 and serves to display customer-specific information to a customer, is disposed in the upper region of the housing 14.

A second display arrangement 17, via which information for the service personnel or the counter personnel is displayed, is disposed on the opposite side of the housing 14, preferably in the upper region. A switch 18, via which the service personnel or the counter personnel can activate the operation of the dishwasher 1, is provided in addition to the second display arrangement 17.

In the design example shown, the treatment zone 3 accommodated in the housing 14 is used to carry out a washing phase, then optionally a disinfecting phase, then a rinsing phase with hot fresh water and optionally a rinsing phase with cold fresh water, in chronological succession. In this context, it is in principle also conceivable for an additional drying phase to subsequently take place in the treatment zone 3.

The washing phase is a cleaning phase, in which the washware items 2 or the washware item 2 in the treatment zone 3 are washed with a washing liquid. The optional disinfecting phase is a cleaning or treatment phase, in which the washed washware item 2 is exposed to either a disinfectant chemical or hot fresh water or hot steam to effect appropriate disinfection. The rinsing phase is a cleaning phase, in which the washed washware item 2 and the possibly disinfected washware item 2 are rinsed with heated fresh water and optionally added rinse aid.

To be able to carry out these process steps, the dishwasher 1 preferably comprises two independent liquid systems. A first liquid system is a washing water circuit which is responsible for washing the washware item, whereby washing is carried out with recirculated water from a wash tank 9 of the dishwasher 1.

The other liquid system is a fresh water system, which is responsible for rinsing. As already mentioned, rinsing is carried out with fresh water, preferably fresh water from a water heater. After the spraying in the treatment zone 3, the fresh water is likewise taken into the wash tank 9 of the dishwasher 1.

The primary task of rinsing is to remove any remaining suds on the washware item 2. The rinsing water flowing in the wash tank 9 during the rinsing phase is used to regenerate the washing water in the wash tank 9.

Before fresh water is sprayed as a rinsing liquid by the rinsing phase and thereby fed into the wash tank 9 of the dishwasher 1, a quantity of washing liquid equal to the quantity of fresh water is preferably pumped out of the wash tank 9.

The example embodiment of the dishwasher 1 according to the invention, as shown schematically in the drawings, is in particular characterized by the fact that it is spatially partitioned into an over table area 6 and an under table area 7. When the dishwasher 1 is used as intended, the over table area 6 is above a counter level 12, whereas, when the dishwasher 1 is used as intended, the under table area 7 is below the counter level 12.

It is in particular provided that the components which are necessary and can be controlled to carry out the cleaning phases in the treatment zone 3 are accommodated in the under table area 7 of the dishwasher 1. These are in particular the washing and/or rinsing pump(s) 8 of a washing and/or rinsing system of the dishwasher 1, i.e. the pumps associated with the washing water circuit and the fresh water system of the dishwasher 1.

The wash tank 9 of the dishwasher 1, and possibly a wastewater tank, are preferably likewise accommodated in the under table area 7 of the dishwasher 1. As already stated at the outset, the wash tank 9 is used to at least temporarily store the cleaning liquid to be sprayed in the treatment zone 3 of the dishwasher 1 or to temporarily store the cleaning liquid sprayed in the treatment zone 3.

It is also advantageous if a fresh water tank or rinsing liquid tank 10, which provides at least a portion of the rinsing liquid or fresh water to be sprayed in the treatment zone 3, is accommodated in the under table area 7 of the dishwasher 1 as well.

A rinse aid dosing system for in particular selective and/or as needed dosing of rinse aid to the cleaning liquid to be sprayed in the treatment zone 3 and/or a cleaner dosing system for in particular selective and/or as needed dosing of a cleaner chemical to the cleaning liquid to be sprayed in the treatment zone 3 can also be accommodated in the under table area 7 of the dishwasher 1.

The same is true for an optionally provided disinfectant dosing system for as needed dosing of a disinfectant to the cleaning liquid to be sprayed in the at least one treatment zone 3.

A water heater (booster) for selective and/or as needed heating of the cleaning liquid, in particular rinsing liquid, to be sprayed in the treatment zone 3 is preferably disposed in the under table area 7 of the dishwasher 1 as well.

In the over table area 6 of the dishwasher 1, on the other hand, preferably only the placement area 4, the removal area 5 and at least partly the area of the treatment zone 3 of the dishwasher 1 are provided. The treatment zone 3, or a corresponding washing and/or spray nozzle system associated with the treatment zone 3, is fluidically connected to the washing liquid system and the rinsing liquid system and the corresponding components of the washing and/or rinsing system accommodated in the under table area 7 of the dishwasher 1.

The washing or spray nozzle system is preferably disposed below the treatment zone 3, whereby a lateral arrangement of corresponding washing and/or spray nozzles and/or an arrangement of washing and/or spray nozzles above the treatment zone 3 is in principle conceivable too. In particular at least a portion of the washing and/or spray nozzles is disposed below the treatment zone 3 in a corresponding trough-shaped region, specifically with a spray direction oriented upward into the treatment zone 3.

A bracket 15 is provided in the treatment zone 3 in order to releasably secure and in particular position a washware item 2 placed into the treatment zone 3 with respect to the washing and/or spray nozzles. The bracket 15 is in particular configured to position and/or true a drinking vessel independently and preferably in the middle and in particular centrally in the treatment zone 3.

The bracket 15 should in particular be configured such that a drinking vessel can be brought, preferably manually and in particular with one hand, into operative connection with the bracket 15 via the placement area 4 and can be removed, preferably manually and in particular with one hand, from the bracket 15 via the removal area 5.

In the embodiment shown in the drawings, the bracket 15 comprises two oppositely disposed, in particular spring-loaded holding elements 25, between which a holding region for the drinking vessel is formed. The bracket 15 is configured such that a drinking vessel can be introduced, in particular placed, manually into the holding region via the placement area 4, preferably in a horizontal movement, and can be removed preferably manually from the holding region via the removal area 5.

Per FIGS. 14*a*-18*b*, the bracket 15 comprises a drinking vessel receptacle, in particular in the form of a depression or in the form of a groove region, which, here, is formed by outwardly extending depressions or grooves 25*a* in each holding element 25. The depressions or grooves 25*a* are, here, located on the holding elements 25 between the placement area 4 and the removal area 5 to form the vessel holding region, for positioning and/or truing a drinking vessel, which is in particular in an upside-down state of said drinking vessel, in the treatment zone 3. Each holding element 25 includes an angled entry surface 25*b* that faces partly toward the placement area 4 and that angles outwardly and away from the depression or groove region 25*a*, which configuration facilitates manual movement of a drinking vessel, in particular with one hand, from the placement area 4 horizontally into the space between the holding elements 25, by the drinking vessel engaging with the entry surfaces 25*b* to move the holding elements outwardly, against the bias, until the drinking vessel reaches the holding region between the depressions or groove regions 25*a*.

The drawings also do not show that a cleaning system having at least one cleaning nozzle and configured to preferably automatically clean the placement area 4 is associated with the placement area 4 of the dishwasher 1.

It can be seen from the drawings that, in the example embodiment, the dishwasher 1 comprises a body 11 having an upper horizontal plane which defines the counter level 12 or is positioned below the actual counter level 12. The under table area 7 of the dishwasher 1 is formed by the body 11, whereby, in this case, the body 11 comprises height-adjustable feet 13, with which the body 11 is supported.

The body region is equipped with removable wall elements or a door 19, for example to allow access to the technology accommodated in the under table area 7 of the dishwasher 1 for maintenance reasons.

Due to the compactness of the dishwasher 1, the placement opening of the placement area 4 can be correspondingly small. If the dishwasher 1 is used to clean drinking vessels, in particular reusable drinking vessels such as coffee cups, as in the example embodiment shown in the drawings, the placement opening of the placement area 4 can be slightly higher than the drinking vessel to be treated.

Although not shown in the drawings, the placement opening of the placement area 4 of the dishwasher 1 can be associated with a guide slot corresponding to the drinking vessel to be cleaned in order to provide an orientation of the drinking vessel when the drinking vessel is placed into the placement area 4.

Alternatively, it is also conceivable for the bracket 15 in the treatment zone 3 to be configured to only accommodate drinking vessels in a defined orientation.

The dishwasher 1 preferably comprises a control device, which is not explicitly shown in the drawings, to appropriately control the at least one door, in particular the revolving door, as well as the controllable components associated with the treatment zone 3 and the display arrangements 16, 17. The control device is in particular configured to control the controllable components of the treatment zone 3 or the washing and rinsing system of the treatment zone 3 as a function of a presence or absence of a drinking vessel in the placement area 4, in the removal area 5 or in the area of the treatment zone 3.

Due to its design and size, the dishwasher 1 according to the invention is in particular configured to be integrated into the counter concept of a coffee shop, for example, so that a dirty cup can be placed into the machine in an area in front of the counter by the customer, and the clean cup can then be removed from the machine by the personnel behind the counter after the cleaning process has been carried out, to then refill said cup directly in accordance with the customer's order. More specifically, it is in particular provided that the technology for the washing and/or rinsing system is accommodated in the under table area 7 of the dishwasher 1, so that as much space as possible is available in the over table area 6 of the dishwasher 1, so that the entire dishwasher 1 can easily be integrated into the counter concept of a coffee shop, for example.

It is in particular advantageous for the dishwasher 1 to comprise a door, in particular a revolving or Tambour door, to close the access opening to the placement area 4 of the dishwasher 1 as needed. The door can be manually or automatically actuatable. If the door is automatically actuated, the placement area 4 can be associated with a sensor system, which is configured to detect the presence of a washware item in the placement area 4 or in the area of the treatment zone 3, whereby the sensor system actuates a door mechanism to close the door and start a treatment program of the dishwasher 1 when a washware item is detected.

In the same way, it is advantageous if the removal area 5 is likewise associated with a corresponding door. The door should in particular be retractable in vertical direction into the body 11 of the dishwasher 1 when in the open position. Alternatively, it is conceivable for the door to be retractable in horizontal direction into the side wall region of the housing for the treatment zone 3.

The over table area of a further example embodiment of the dishwasher according to the invention is described in more detail in the following with reference to the illustrations in FIG. 15*a* to FIG. 18*b*.

The over table area of this example embodiment is characterized by the fact that the placement surface 20 in the treatment zone 3 is inclined relative to the horizontal in the direction the removal area 5. Of course, it is also conceivable that the placement surface 20 is implemented to be inclined in the direction of the placement area 4 or in a different direction relative to the horizontal.

It can also be seen in the drawings that the placement surface 20 is formed by a strut structure, in particular a lattice-like strut structure.

The sectional views according to FIG. 17*a*, FIG. 17*b*, FIG. 18*a*, and FIG. 18*b* show that a revolving door 18 is disposed in the housing 14 for the treatment zone 3. The revolving door 18 is designed as an element which surrounds the treatment zone 3 and comprises a first and an opposite second through-opening and is rotatable relative to the placement opening and the removal opening of the treatment zone 3 such that at least a first state, in which the first through-opening is at least substantially aligned with the placement opening of the treatment zone 3 and the second through-opening is at least substantially aligned with the removal opening of the treatment zone 3, and a second state, in which the surrounding element at least substantially completely covers both the placement opening and the removal opening of the treatment zone 3, can selectively be implemented. It should be noted here that FIG. 14*a* to FIG. 18*b* show the revolving door 18 in the first state.

A corresponding motor 21 for actuating the revolving door 18 is accommodated in the upper region of the housing. The first and second display arrangement 16, 17 are disposed in the upper region of the housing 14 for the treatment zone 3 as well.

In the example embodiment of the over table area 6 of the dishwasher 1 according to the invention shown in FIG. 14*a* to FIG. 18*b*, the bracket 15 for the washware item 2 is likewise disposed in the treatment zone 3. In this case, the bracket 15 is used to position and orient or true the washware items 2 with respect to the washing and/or rinsing nozzle 22 of the washing and/or rinsing system of the dishwasher 1. The washing and/or rinsing nozzle 22 can also be used as an air-blowing nozzle to blow compressed air in the direction of the washware item 2, in particular after completion of a rinsing phase.

In the example embodiment of the over table area 6 of the dishwasher 1 shown in FIG. 14*a* to FIG. 18*b*, the bracket 15 simultaneously serves as a support arrangement to appropriately support the washware item 2 placed on the inclined placement surface 20.

It should be noted here that the over table area is preferably releasably connectable to the body of the under table area 7 of the dishwasher 1 not shown in FIG. 14*a* to FIG. 18*b*.

As a further development, it is further conceivable that an under table area 7 is used to serve two or a plurality of over table areas 6.

The invention is not limited to the embodiments shown in the drawings, but results when all of the features disclosed herein are considered together.

LIST OF REFERENCE SIGNS

1 Dishwasher
2 Washware item
3 Treatment zone
4 Placement area
5 Removal area
6 Over table area
7 Under table area
8 Washing and/or rinsing pump
9 Wash tank
10 Rinsing liquid tank
11 Body
12 Counter level
13 Height-adjustable feet
14 Housing for the treatment zone
15 Bracket
16 First display arrangement
17 Second display arrangement
18 Door/revolving door
19 Door of the body
20 Placement surface
21 Motor
22 Washing and/or spray nozzle

The invention claimed is:

1. A dishwasher for cleaning a washware item in the form of a drinking vessel, wherein the dishwasher is configured as a counter module of a counter system and comprises a housing with at least one treatment zone and having a placement opening for manually placing the washware item into the treatment zone and a removal opening for manually removing the washware item from the treatment zone, wherein the placement opening and the removal opening are disposed on opposite first and second sides of the housing, wherein at least one bracket is provided in the treatment zone for releasably securing and/or positioning the washware item placed onto a placement surface in the treatment zone;

wherein the at least one bracket comprises first and second spring-loaded bracket parts arranged at opposing internal sidewalls of the housing, the first and second spring-loaded brackets being perpendicular to the placement opening and between which a holding region is formed, the first and second spring-loaded bracket parts biased toward the holding region into respective inward positions and movable outward, against the bias, upon contact with the washware item during placement of the washware item into the treatment zone and onto the placement surface, wherein, when the first and second spring-loaded bracket parts are in the inward positions, a gap between the first and second bracket parts is aligned along and provides a clear path from the placement opening to the removal opening;

wherein each of the first and second spring-loaded bracket parts comprises:

a depression or groove facing the holding region, and an angled entry surface that faces partly toward the placement opening and that angles outwardly and away from the depression or groove and the holding region so as to be configured to facilitate manual movement of the drinking vessel into the holding region by engaging with the entry surfaces to move the first and second spring-loaded bracket parts outwardly, against the bias, until the drinking vessel reaches the placement surface.

2. The dishwasher according to claim 1, wherein the first and second spring-loaded bracket parts are positioned and configured to independently position and/or orient the washware item in the treatment zone with respect to a jet direction, of at least one washing and/or spray nozzle of the dishwasher, wherein the first and second spring-loaded bracket parts are further configured such that the washware item can be brought, manually and with one hand, into operative connection with the first and second spring-loaded bracket parts.

3. The dishwasher according to claim 1, wherein the placement surface is at least partly inclined relative to horizontal, by an angle of 5° to 35°; and/or wherein the placement surface is formed at least partly by a lattice-like strut structure.

4. The dishwasher according to claim 1, wherein the dishwasher comprises an air-blowing system having at least one air-blowing nozzle, which, to optimize a drying result of the washware item, is configured and oriented with respect to the placement surface such that water droplets can be blown off the washware item with the air-blowing nozzle, wherein the air-blowing system is configured to automatically blow compressed air toward the washware item via the air-blowing nozzle after completion of a rinsing phase, or to automatically blow compressed air toward the washware item via the air-blowing nozzle as the washware item is removed from the treatment zone.

5. The dishwasher according to claim 1, wherein wherein the treatment zone is associated with at least one door, in the form of a revolving door, via which the placement opening and/or removal opening can be closed as needed and automatically after placement of the washware item into the treatment zone, wherein the at least one door is transferable in a horizontal plane relative to the treatment zone between an open position, in which the placement opening and the removal opening are open, and a closed position, in which the placement opening and the removal opening are closed.

6. The dishwasher according to claim 5, wherein the at least one door at least partly surrounds the treatment zone and comprises a first and a second through-opening and is movable relative to the placement opening and the removal opening such that at least a first state, in which the first through-opening is at least substantially aligned with the placement opening of the treatment zone and the second through-opening is at least substantially aligned with the removal opening of the treatment zone, and a second state, in which the at least one door at least substantially completely covers both the placement opening and the removal opening of the treatment zone, can selectively be implemented, wherein the at least one door is a peripheral revolving door which is disposed inside the housing and is mounted such that is displaceable or rotatable, about a horizontal or vertical central axis of the treatment zone, relative to the placement opening and the removal opening of the treatment zone, and wherein at least one window region is configured in the at least one door such that, in the second state of the door, the treatment zone can be visually inspected through the placement opening and/or removal opening.

7. The dishwasher according to claim 1, wherein the dishwasher further comprises a washing and/or rinsing system having a washing and/or rinsing pump and washing and/or rinsing nozzles, via which cleaning liquid, can be sprayed onto the washware item in the treatment zone, wherein the dishwasher is spatially partitioned into an over table area, which, when the dishwasher is used as intended, is positioned above a counter level, and an under table area, which, when the dishwasher is used as intended, is positioned below the counter level, wherein the placement opening, the removal opening and at least partly the at least one treatment zone are respectively part of the over table area, and wherein at least the washing and/or rinsing pump of the washing and/or rinsing system is part of the under table area.

8. The dishwasher according to claim 7, wherein the washing and/or rinsing system further comprises at least one of the following components:

a rinse aid dosing system for selective and/or as needed dosing of rinse aid to the cleaning liquid to be sprayed in the at least one treatment zone;

a cleaner dosing system for selective and/or as needed dosing a cleaner chemical to the cleaning liquid to be sprayed in the at least one treatment zone;

a wash tank for at least temporarily storing the cleaning liquid to be sprayed in the at least one treatment zone and/or for temporarily storing the cleaning liquid sprayed in the at least one treatment zone;

a rinsing liquid tank for providing rinsing liquid to be sprayed in the at least one treatment zone;

a wastewater tank for at least temporarily storing wastewater produced during the cleaning of the washware items;

a water heater for selective and/or as needed heating of the cleaning liquid to be sprayed in the at least one treatment zone; and/or a disinfectant dosing system for as needed dosing of a disinfectant to the cleaning liquid to be sprayed in the at least one treatment zone, wherein the at least one component of the washing and/or rinsing system is part of the under table area of the dishwasher.

9. The dishwasher according to claim 7, wherein the dishwasher comprises a body having an upper horizontal plane, which is positioned below the counter level or which defines the counter level, wherein the under table area of the dishwasher is formed by the body, and wherein the body is supported by height-adjustable feet or castors or by an height-adjustable substructure, base or frame, wherein the upper horizontal plane of the body is configured at least partly as an upper floor, the surface of which is below the counter level or defines the counter level, wherein in a region of the at least one treatment zone the upper floor further comprises at least one passage or opening, via which cleaning liquid can be transferred from the under table area to the upper table area and vice versa, and wherein the placement surface is disposed below the counter level.

10. The dishwasher according to claim 7, wherein the housing includes at least one wall region provided above the counter level and an upper roof region, wherein the dishwasher comprises a first display arrangement at the first side of the housing and disposed at the upper roof region for displaying customer-specific information, and comprises a second display arrangement at the second side of the housing and disposed at the upper roof region for displaying counter personnel-specific information, and wherein the treatment zone is associated with at least one door, in the form of a revolving door, via which the placement opening and/or the removal opening can be closed as needed and automatically after placement of the washware item into the treatment zone, wherein the at least one door is transferable in a horizontal or vertical plane relative to the treatment zone between an open position, in which the placement opening and the removal opening are open, and a closed position, in which the placement opening and the removal opening are closed, wherein, in the open position of the at least one door, said door does not project above the upper roof region of the dishwasher.

11. The dishwasher according to claim 1, wherein the dishwasher has a dimension adapted to a counter size and includes a counter structure, wherein a footprint of the counter structure has a dimension of no more than 500 mm×500 mm, and wherein the footprint of a body below the counter structure has a dimension of no more than 400 mm×600 mm; and/or wherein the placement opening has a height of no more than 330 mm and a width of no more than 260 mm; and/or wherein the dishwasher comprises a control device, via which treatment parameters necessary and/or desired for cleaning the washware item can be selected and/or set, wherein the control device is configured to control a washing and/or rinsing system of the dishwasher for treating the washware item in the at least one treatment zone such that first at least one washing phase and then at least one rinsing phase, is carried out in chronological succession, wherein the control device is further configured to control the washing and/or rinsing system of the dishwasher for treating the washware items in the at least one treatment zone such that at least one disinfecting phase is carried out between the at least one washing phase and the at least one rinsing phase, wherein the at least one washing phase lasts between 5 to 30 seconds and wherein the rinsing phase lasts between 1 to 10 seconds.

12. A counter module for a counter system, wherein the counter system comprises a counter area having a horizontal counter surface, and wherein the counter module comprises a dishwasher according to claim 1, wherein an over table area of the dishwasher is disposed above the counter surface of the counter area and an under table area of the dishwasher is disposed below the counter surface of the counter area.

* * * * *